US007241548B2

(12) United States Patent
Sugiyama et al.

(10) Patent No.: US 7,241,548 B2
(45) Date of Patent: Jul. 10, 2007

(54) TONER, METHOD FOR PREPARING THE TONER, AND IMAGE FORMING METHOD AND APPARATUS USING THE TONER

(75) Inventors: Tsunemi Sugiyama, Yokohama (JP); Hiroshi Yamashita, Numazu (JP); Yohichiroh Watanabe, Fuji (JP); Shinji Ohtani, Suntoh-gun (JP); Takuya Saito, Numazu (JP)

(73) Assignee: Ricoh Company Limited, Tokyo (JP)

( * ) Notice: Subject to any disclaimer, the term of this patent is extended or adjusted under 35 U.S.C. 154(b) by 395 days.

(21) Appl. No.: 10/876,718

(22) Filed: Jun. 28, 2004

(65) Prior Publication Data

US 2005/0003288 A1 Jan. 6, 2005

(30) Foreign Application Priority Data

Jul. 1, 2003 (JP) ..... 2003-189576
Dec. 9, 2003 (JP) ..... 2003-410297

(51) Int. Cl.
*G03G 5/00* (2006.01)

(52) U.S. Cl. ..... 430/137.14; 430/137.15; 430/110.1; 430/108.1

(58) Field of Classification Search ..... 430/137.14, 430/137.15, 137.17, 110.1, 108.1
See application file for complete search history.

(56) References Cited

U.S. PATENT DOCUMENTS 5,364,729 A * 11/1994 Kmiecik-Lawrynowicz et al. ..... 430/137.14
5,368,972 A 11/1994 Yamashita et al.
5,418,103 A 5/1995 Muto et al.
5,576,393 A 11/1996 Yamashita et al.
6,140,000 A 10/2000 Yamashita
6,251,556 B1 * 6/2001 Yoshida et al. ..... 430/109.3
6,503,676 B2 1/2003 Yamashita et al.
6,733,939 B2 5/2004 Nanya et al.
6,740,460 B2 5/2004 Tomita et al.

(Continued)

FOREIGN PATENT DOCUMENTS

EP 0 631 195 A1 12/1994

(Continued)

OTHER PUBLICATIONS

U.S. Appl. No. 11/376,286, filed Mar. 16, 2006, Ohtani.

(Continued)

*Primary Examiner*—Mark A. Chapman
(74) *Attorney, Agent, or Firm*—Oblon, Spivak, McClelland, Maier & Neustadt, P.C.

(57) ABSTRACT

A method for preparing a toner including toner particles, including granulating a toner constituent mixture to prepare toner constituent particles having a polar group with a first polarity on a surface thereof; and mixing a surfactant having a second polarity different from the first polarity and a particulate material with the toner constituent particles to prepare the toner particles. A toner prepared by the method mentioned above. An image forming method including developing a latent image with the toner; transferring the toner image on a receiving material optionally via an intermediate transfer medium, and fixing the toner image on the receiving material. A process cartridge including a developer container containing a developer including the toner mentioned above, and at least one of an image bearing member; a charger; a developing device; and a cleaner.

18 Claims, 4 Drawing Sheets

U.S. PATENT DOCUMENTS

| | | | | |
|---|---|---|---|---|
| 7,074,541 | B2 * | 7/2006 | Yamashita et al. ..... | 430/137.14 |
| 2005/0003288 | A1 | 1/2005 | Sugiyama et al. | |
| 2005/0196691 | A1 | 9/2005 | Ohtani et al. | |

FOREIGN PATENT DOCUMENTS

| | | |
|---|---|---|
| JP | 5-107808 | 4/1993 |
| JP | 6-242632 | 9/1994 |
| JP | 7-152202 | 6/1995 |
| JP | 11-149179 | 6/1999 |
| JP | 2003-84502 | 3/2003 |

OTHER PUBLICATIONS

U.S. Appl. No. 11/227,566, filed Sep. 16, 2005, Nagatomo et al.
U.S. Appl. No. 11/219,740, filed Sep. 7, 2005, Sugiyama et al.
U.S. Appl. No. 11/513,175, filed Aug. 31, 2006, Ohki et al.
U.S. Appl. No. 11/519,893, filed Sep. 13, 2006, Inoue et al.
U.S. Appl. No. 11/487,374, filed Jul. 17, 2006, Yamashita et al.

* cited by examiner

TONER, METHOD FOR PREPARING THE TONER, AND IMAGE FORMING METHOD AND APPARATUS USING THE TONER

BACKGROUND OF THE INVENTION

1. Field of the Invention

The present invention relates to a toner for use in developers which develop electrostatic latent images formed by electrophotography, electrostatic recording and electrostatic printing. More particularly, the present invention relates to a toner for use in developers for mono-color or full color image forming apparatus using a direct or indirect electrophotographic image forming method, such as copiers, laser printers and plain paper facsimiles. In addition, the present invention also relates to a method for preparing the toner, and an image forming method and an image forming apparatus (such as a process cartridge) using the toner.

2. Discussion of the Background

Electrophotographic developer is typically used for image forming methods such as electrophotography, electrostatic recording and electrostatic printing. The image forming methods typically include the following processes:

(1) an electrostatic latent image formed on an image bearing member such as photoreceptors or dielectric materials is developed with a developer including a toner to form a toner image on the image bearing member (developing process);

(2) the toner image is transferred on a receiving material such as receiving papers optionally via an intermediate transfer medium (transfer process); and (3) the toner image is fixed on the receiving material upon application of heat and/or pressure, or the like (fixing process).

Dry developers are broadly classified into two-component developers which typically consist of a dry toner and a carrier, and one-component developers which are magnetic or non-magnetic and which are typically constituted of a toner and do not include a carrier.

Conventional electrophotographic dry toners for use in electrophotography, electrostatic recording and electrostatic printing are typically prepared by the following pulverization method:

(1) a toner constituent mixture including a colorant, a binder resin (e.g., styrene resins and polyester resins) and optional additive is kneaded upon application of heat thereto (kneading process); and (2) after being cooled, the kneaded mixture is pulverized to prepare toner particles.

Recently, it is attempted to decrease the particle diameter of toner in order to produce high quality toner images. The toner particles prepared by the pulverization method mentioned above have irregular forms, and therefore the toner particles are further pulverized in image forming apparatus due to the stresses applied to the toner particles by carriers included in developers, developing rollers, toner supplying rollers, toner layer thickness controlling blades and frictional charge applying blades included in the image forming apparatus. As a result, super fine toner particles are produced and/or a fluidity improving agent located on the surface of the toner particles is embedded into the toner particles, resulting in deterioration of image qualities. In addition, such pulverized toners have poor fluidity due to their particle form, and therefore it is necessary to include a large amount of fluidity improving agent therein. Further, the toners have low packing ability (i.e., the amount of a toner contained in a container is relatively small), and thereby the toner bottle has to be enlarged in size. Therefore, it becomes difficult to design a compact image forming apparatus.

Namely, the advantage of the toner having a small particle diameter is not effectively exploited. Further, there is a limit to the particle diameter of a toner prepared by a pulverization method (namely, the particle diameter of a toner cannot be further decreased by a pulverization method).

Recently, color images are popularly produced in offices. Color image forming apparatus have a complex structure and use a complex image transfer device because plural toner images have to be transferred on proper positions of a receiving material. When a toner prepared by a pulverization method is used for such color image forming apparatus, a problem such that the transferred toner images have omissions due to poor transferability of the toner used occurs. In attempting to avoid this problem by increasing the amount of toner adhered to the electrostatic latent images, another problem in that the toner consumption increases occurs.

Therefore a need exists for enhancement of toner image transfer efficiency, which results in production of high quality images and reduction of toner consumption (i.e., reduction of running costs). When a toner having an excellent transfer efficiency is used, it becomes unnecessary to use a cleaning device, and thereby the image forming apparatus can be miniaturized and the manufacturing costs of the apparatus can be reduced. In addition, the image forming apparatus have such an advantage as to produce no waste toner.

In attempting to solve the problems specific to the toners having a small particle diameter and irregular forms, various toners and various toner preparing methods have been proposed.

For example, suspension polymerization methods and emulsion polymerization/aggregation methods in which particles are prepared by emulsion polymerization, followed by aggregation of the emulsified particles have been investigated. In addition, polymer solution emulsifying techniques utilizing reduction of volume of toner particles have been proposed. Specifically, the methods include the following steps:

(1) toner constituents are dissolved or dispersed in a volatile solvent such as organic solvents having a low boiling point;

(2) the solution or dispersion is dispersed in an aqueous medium including a dispersant to form an emulsion; and (3) the volatile solvent is removed from the emulsion to prepare a dispersion including toner particles.

One of the polymer solution emulsifying methods is disclosed in published unexamined Japanese Patent Application No. (hereinafter JP-A) 07-152202.

The method has the following advantages over the suspension polymerization methods and emulsion polymerization/aggregation methods:

(1) a variety of resins can be used as the binder resin of the toner; and (2) particularly, polyester resins which are suitable for toners for use in full color image forming because the resins have good transparency and the resultant toner images have smooth surface can be used as the binder resin.

However, the method has a drawback in that the resultant toner has a substantially spherical form, and therefore the toner has poor cleanability when cleaning is performed using a cleaning blade. In addition, the fluidity improving agent which is present on a surface of toner particles is easily embedded into the toner particles, resulting in deterioration of fluidity, and thereby the replenishing property, developing property and charging property of the toner are also deteriorated.

A modified polymer solution emulsifying method is disclosed in JP-A 11-149179 in which a low molecular weight resin is used to reduce the viscosity of the polymer solution or dispersion and to easily perform the emulsification, and the low molecular weight resin is then polymerized in the particles of the emulsion to improve the fixability of the resultant toner. By using this method, the polymerization reaction tends to proceed at the surface of the particles, and thereby the resultant particles have a hard surface. Therefore, the problem in that the fluidity improving agent is embedded into the toner particles can be avoided. However, there is a large amount of free particles of the fluidity improving agent in the toner, thereby causing a problem in that the free fluidity improving agent particles adhere to various image forming members such as photoreceptors and developing rollers, resulting in deterioration of image qualities.

The toners mentioned above are prepared by granulated in an aqueous medium. However, the toners prepared by granulated in an aqueous medium have a drawback in that the charge properties thereof cannot be controlled. Specifically, toners prepared by conventional pulverizing methods which includes the steps of melt-kneading toner constituents including a charge controlling agent to uniformly disperse the charge controlling agent therein; and pulverizing the kneaded mixture such that the charge controlling agent is present on the surface of the resultant toner particles with a certain probability. In contrast, the toners prepared by the in-water granulation methods tend to include a charge controlling agent inside the toner particles (i.e., the charge controlling agent is hardly present on the surface of the toner particles) if the charge controlling agent has a high hydrophobic property. Therefore, good charge property cannot be imparted to the toner particles.

To the contrary, when the charge controlling agent has a hydrophilic property, the charge controlling agent tends to migrate into the aqueous phase during the granulation process, and thereby the resultant toner particles hardly include the charge controlling agent. Namely, it is hard to include a charge controlling agent in a surface portion of toner particles by the in-water granulation methods.

Recently, a strong need exists for an energy-saving electrophotographic image forming apparatus (such as copiers and printers). Therefore, a need exists for a toner having further improved low temperature fixability. In order to improve the low temperature fixability of a toner, it is necessary to decrease the melt viscosity of the toner. In this case, an offset problem occurs in that a toner image is undesirably transferred to a fixing roller and the image is re-transferred to a portion of other images, resulting in formation of undesired images. It is effective to lower the glass transition temperature (Tg) of a binder resin included in a toner, in order to improve the low temperature fixability of the toner, but the preservability of the resultant toner deteriorates.

In order to impart good charge property to a toner, techniques in which a charge controlling agent is externally added to toner particles have been proposed. In addition, in order to prevent deterioration of high temperature preservability caused when it is tried to improve low temperature fixability, methods in which a layer having a relatively high heat resistance property is formed on a surface of toner particles have been investigated.

Japanese patent No. 3104883 (i.e., JP-A 05-107808) discloses a toner in which resin particles having a surface treated with a fluorine-containing surfactant are fixed on the toner particles. However, in this case the resin particles tend to be unevenly present on the surface of the toner particles.

JP-A 06-242632 discloses a toner in which a complex particulate resin prepared by reacting a particulate resin having an acid group with a fluorine-containing quaternary ammonium salt is fixed on the surface of the toner particles in the presence of a nonionic surfactant. However, this technique is used for controlling the charge property of the toner, and therefore there is no description about influence of a particulate inorganic material, which is added to the toner particles as an external additive to improve the fluidity of the toner, on the complex particulate resin. In addition, the resin particles tend to be unevenly present on the surface of the toner particles.

Further, JP-A 2003-84502 discloses a toner in which a particulate material having a charge with a first polarity opposite to that of the mother toner particles is adhered to mother toner particles to impart a charge with the first polarity to the resultant toner. However, the resultant toner has uneven charge property, namely, there are many toner particles having a charge with a polarity opposite to the desired polarity.

Because of these reasons, a need exists for a toner which has good high temperature preservability and which has so good charge property, transfer property and fixing property as to produce high quality (color) images in a relatively small amount of heat energy.

SUMMARY OF THE INVENTION

Accordingly, an object of the present invention is to provide a toner which has good high temperature preservability and which has so good charge property, transfer property and fixing property as to produce high quality (color) images in a relatively small amount of heat energy.

Another object of the present invention is to provide a method for preparing the toner mentioned above.

Yet another object of the present invention is to provide an image forming method and an image forming apparatus by which high quality images can be produced with a relatively low energy.

Briefly these objects and other objects of the present invention as hereinafter will become more readily apparent can be attained by a method for preparing a toner including toner particles, which includes:

granulating a toner constituent mixture to prepare toner constituent particles having a polar group with a first polarity on a surface thereof; and mixing a surfactant having a second polarity different from the first polarity and a particulate material with the toner constituent particles to prepare the toner particles in which the particulate material is present on the surface of the toner constituent particles.

The particulate material is preferably a particulate organic material or a particulate inorganic material.

The granulating step can include the following steps:

dissolving or dispersing at least a colorant in a polymerizable monomer to prepare a toner constituent mixture liquid;

dispersing the toner constituent mixture liquid in an aqueous medium comprising a surfactant to prepare an emulsion; and polymerizing the emulsion to prepare a suspension of toner constituent particles.

Alternatively, the granulating step can include the following steps:

dispersing a toner constituent mixture including at least a resin and a colorant in an aqueous medium including a surfactant to prepare a toner constituent mixture liquid;

aggregating particles in the toner constituent mixture liquid; and heating the aggregated particles to fuse the aggregated particles in the aqueous medium to prepare a suspension of toner constituent particles.

Alternatively, the granulating step can include the following steps:

dissolving or dispersing a toner constituent mixture including at least a resin and a colorant in an organic solvent to prepare a toner constituent mixture liquid;

dispersing the toner constituent mixture liquid in an aqueous medium to prepare an emulsion; and removing the organic solvent from the emulsion to prepare a suspension of toner constituent particles.

Alternatively, the granulating step can include the following steps:

dissolving or dispersing a toner constituent mixture including at least a resin and a colorant in an organic solvent to prepare a toner constituent mixture liquid;

dispersing the toner constituent mixture liquid in an aqueous medium to prepare an emulsion;

subjecting the toner constituent mixture liquid to an addition polymerization reaction; and removing the organic solvent from the toner constituent mixture liquid to prepare a suspension of toner constituent particles.

The addition polymerization reaction mentioned above is preferably performed using a compound (such as prepolymers) having an isocyanate group.

The polar group present on the surface of the toner constituent particles is preferably a carboxyl group.

When the polar group is an acidic group, the surfactant is preferably one member selected from the group consisting of cationic surfactants, nonionic surfactants and ampholytic surfactants. When the polar group is a basic group, the surfactant is preferably one member selected from the group consisting of anionic surfactants, nonionic surfactants and ampholytic surfactants.

The surfactant is preferably a fluorine-containing surfactant, such as cationic surfactants including a perfluoralkyl group and compounds having the following formula (1):

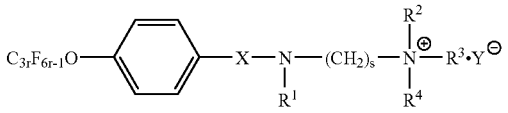

(1)

wherein X represents —$SO_2$, or —CO—; Y represents I or Br; $R^1$, $R^2$, $R^3$ and $R^4$ independently represent a hydrogen atom, an alkyl group having 1 to 10 carbon atoms or an aryl group; and each of r and s is an integer of from 1 to 20.

The particulate organic material preferably has a glass transition temperature of from 55 to 100° C.

It is preferable that the method further includes:

heating the toner constituent particles in an aqueous medium after the surfactant and the particulate material are mixed with the toner constituent particles.

Another aspect of the present invention, a toner is provided which includes toner particles prepared by the method mentioned above and an optional external additive such as fluidity improving agents.

Yet another aspect of the present invention, an image forming method is provided which includes:

developing an electrostatic latent image on at least one image bearing member with at least one color toner to form at least one color toner image on the at least one image bearing member;

transferring the at least one toner image on a receiving material; and fixing the at least one toner image on the receiving material, wherein the at least one toner is the toner mentioned above.

The toner image can be transferred to a receiving material via an intermediate transfer medium. In this case, an electric field is preferably applied to the intermediate transfer medium when the toner image is transferred to the intermediate transfer medium.

In the image forming method mentioned above, a plurality of image bearing members and respective plural color toners can be used to form a plurality of color toner images on the respective image bearing members.

A further aspect of the present invention, a process cartridge is provided which includes:

a developer container containing a developer including the toner mentioned above; and at least one of an image bearing member;

a charger configured to charge the image bearing member to form an electrostatic latent image thereon;

a developing device configured to develop the electrostatic latent image with the developer to form a toner image on the image bearing member; and a cleaner configured to clean a surface of the image bearing member.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
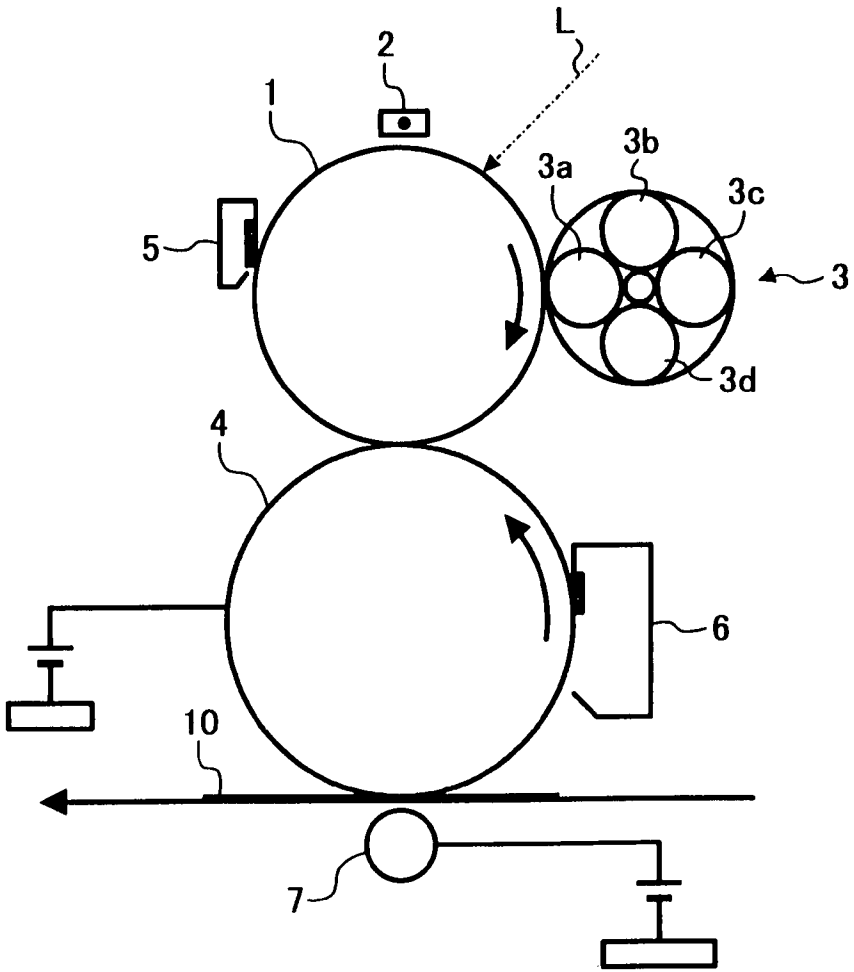
FIG. 1 is a schematic view illustrating an image forming apparatus for use in the image forming method of the present invention.

It is preferable for the toner preparing method of the present invention that during or after the toner constituent particles are prepared, a surfactant having a polar group with a polarity different from that of the polar group present on the surface of the toner constituent particles and at least one of a particulate organic material and a particulate inorganic material are added thereto. Specifically, when an acidic group is present on the surface of the toner constituent particles, a cationic surfactant, a nonionic surfactant and/or an ampholytic surfactant are preferably used. In contrast, when a basic group is present on the surface of the toner constituent particles, an anionic surfactant, a nonionic surfactant and/or an ampholytic surfactant are preferably used.

The reason why the organic or inorganic particles are fixedly adhered to toner particles is considered as follows. If a polar functional group is present on a surface of toner particles, the toner particles are charged while having the same polarity as that of the polar group, and thereby the toner particles are stably dispersed in water. When a surfactant having a polar group with a second polarity different from that of the polar functional group is added thereto, the surfactant is adsorbed, not only on the surface of the toner particles but also on the organic or inorganic particles present therein, thereby neutralizing the charges of the toner particles and the organic or inorganic particles. In this case, when the charges of the toner particles are mainly neutralized by the surfactant, for example, due to difference in adsorption rate, the organic or inorganic particles are attracted by the toner particles. Therefore, the organic or inorganic particles can be uniformly adhered to the surface of the toner particles. Accordingly, it is preferable that only the toner particles are previously treated with a surfactant having a polar group with a second polarity.

The organic or inorganic particles thus adhered to the surface of the toner particles are not easily released therefrom. However, it is preferable that the toner particles having the organic or inorganic particles thereon are heated to fix the organic or inorganic particles on the surface of the toner particles.

In addition, when a surfactant having a perfluoroalkyl group is used, the charge properties of the resultant toner particles can be improved.

The thus prepared toner particles can be mixed with an external additive such as particulate inorganic or organic materials, which maybe the same as or different from the organic or inorganic particles previously added, under dry conditions to improve the fluidity, charge properties of the toner particles.

When the thus prepared toner is used for image forming methods using a single image bearing member, in which a full color image is formed by repeating formation of a color image on an image bearing member using a color toner, followed by transferring of the color toner image on a receiving material; and tandem type image forming methods in which color images formed on respective image forming sections using respective color toners are transferred on a receiving material, high quality images can be produced.

When an intermediate transfer medium is used in the image transferring process, a problem in that plural color images are misaligned (i.e., the plural color images are not transferred to desired positions of a receiving material) can be avoided, but another problem in that toner particles tend to remain on the surface of the intermediate transfer medium, resulting in deterioration of image qualities tends to occur. However, when the toner of the present invention is used, such a problem can be avoided.

Then the toner of the present invention will be explained in detail.

At first, the method for granulating toner constituents will be explained.

Specific examples of the methods for granulating toner constituents include the following methods.

Suspension Polymerization Method

At first, toner constituents such as a colorant, a release agent and optional additives are dispersed in a mixture of one or more monomers and an oil-soluble initiator. The mixture is emulsified in an aqueous medium including a surfactant, a solid dispersant, etc. using one of the below-mentioned emulsifying methods. Then, the emulsion is subjected to a polymerization reaction to prepare polymer particles (i.e., a particulate organic material) including the colorant, release agent and other optional additives.

The thus prepared particles (i.e., toner constituent particles) are mixed with a surfactant with a different polarity and a particulate inorganic material and/or a particulate organic material. In this case, the mixing operation is preferably performed after washing the toner constituent particles to remove the surfactant remaining on the particles therefrom.

Specific examples of the monomers, which can be used for introducing a functional group on a surface of particles, include acids such as acrylic acid, methacrylic acid, α-cyano (meth) acrylic acid, itaconic acid, crotonic acid, fumaric acid, maleic acid, and maleic anhydride; amides such as acrylamide, methacrylamide, and diacetoneamide, and methylol compounds of amides; monomers having an amino group such as vinyl pyridine, vinyl pyrrolidone, vinyl imidazole, ethyleneimine, and acrylates and methacrylates including amino group (e.g., dimethylaminoethyl methacrylate); etc.

In addition, when a dispersant having an acidic group or basic group is used for polymerization, the dispersant tends to remain on the polymerized particles while being adsorbed thereon, and a functional group can be introduced on the surface of the particles.

Emulsion Polymerization/aggregation Methods

A water-soluble initiator and one or more monomers are emulsified in water including a surfactant using a known emulsion polymerization method. An aqueous dispersion in which toner constituents such as a colorant, a release agent and optional additives are dispersed in water is added to the emulsion prepared above. Then the particles of the mixture are aggregated followed by heat treatment to fuse the aggregated particles to form toner constituent particles.

Then the thus prepared particles are mixed with a surfactant with a different polarity and a particulate inorganic or organic material in the same way as mentioned above.

By using the monomers mentioned above for use in the suspension polymerization methods, a functional group can be introduced on the surface of the particles.

Polymer Suspension Methods

At first, toner constituents such as a resin, a prepolymer, a colorant (such as pigments), and additives such as a release agent and a charge controlling agent are dissolved or dispersed in a volatile organic solvent to prepare a toner constituent mixture liquid (i.e., an oil phase liquid). In order to decrease the viscosity of the oil phase liquid, i.e., in order to easily perform emulsification, volatile solvents which can dissolve the resin and prepolymer used are preferably used.

The volatile solvents preferably have a boiling point lower than 100° C. so as to be easily removed after the granulating process.

Specific examples of the volatile solvents include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These solvents can be used alone or in combination. In particular, aromatic solvents such as toluene and xylene, and halogenated hydrocarbons such as methylene chloride, 1,2-dichloroethane, chloroform and carbon tetrachloride are preferably used.

The weight ratio of the solvent to the toner constituent mixture is generally from 10/100 to 900/100.

The thus prepared oil phase liquid is dispersed in an aqueous medium using the below-mentioned dispersing method.

Suitable aqueous media include water. In addition, other solvents which can be mixed with water can be added to water. Specific examples of such solvents include alcohols such as methanol, isopropanol, and ethylene glycol; dimethylformamide, tetrahydrofuran, cellosolves such as methyl cellosolve, lower ketones such as acetone and methyl ethyl ketone, etc.

In order to introduce a functional group on the resultant toner particles, the following methods can be used, but the method is not limited thereto.

(1) a copolymer, which includes a unit obtained by a monomer having a functional group such as monomers mentioned above for use in suspension polymerization, is used as a binder resin;
(2) a polyester resin, which is prepared using an acid monomer having three or more functional groups, is used as a binder resin;
(3) a polyester resin, in which a hydroxyl group located at the end position is esterified by a compound having plural acid groups, is used as a binder resin; and
(4) a dispersant having a polar group, such as surfactants having an acid group, and organic or inorganic resin particles having a polar group, which serves as a dispersion stabilizer, is included in the aqueous medium.

Specific examples of the acid groups for use in the above-mentioned methods include carboxyl groups, sulfonate groups, and phosphate groups.

As the oil phase liquid, an organic solvent including a prepolymer having an active group such as isocyanate groups and other toner constituents such as colorants, release agents and charge controlling agents can also be used. In this case, the prepolymer in the oil phase is reacted with an amine in water, resulting in formation of toner constituent particles.

In order to prepare a stable dispersant in which the oil phase including the prepolymer and other toner constituents in an aqueous medium, it is preferable to mix the oil phase liquid with the aqueous phase while applying a shearing force. The toner constituents such as prepolymers and other constituents can be directly added into an aqueous medium, but it is preferable that the toner constituents are previously dissolved or dispersed in an organic solvent and then the solution or dispersion is mixed with an aqueous medium while applying a shearing force to prepare an emulsion.

As the dispersing machine, known mixers and dispersing machines can be used. Preferably, homogenizers and high pressure homogenizers, which have a high speed rotor and a stator; and dispersing machines using media such as ball mills, bead mills and sand mills can be used.

Further, materials such as colorants, release agents and charge controlling agents can be added to the emulsion or dispersion after the particles are formed. Specifically, colorless particles prepared by the above-mentioned methods can be colored by a known dyeing method.

As the dispersing machine, known mixers and dispersing machines such as low shearing type dispersing machines, high shearing type dispersing machines, friction type dispersing machines, high pressure jet type dispersing machines and ultrasonic dispersing machine can be used.

In order to prepare a dispersion including particles having an average particle diameter of from 2 to 20 μm, high shearing type dispersing machines such as emulsifiers having a rotating blade are preferably used. Specific examples of the marketed dispersing machines of this type include continuous dispersing machines such as ULTRA-TURRAX® (from IKA Japan) POLYTRON® (from KINEMATICA AG), TK AUTO HOMO MIXER® (from Tokushu Kika Kogyo Co., Ltd.), EBARA MILDER® (from Ebara Corporation), TK PIPELINE HOMO MIXER® (from Tokushu Kika Kogyo Co., Ltd.), TK HOMOMIC LINE MILL® (from Tokushu Kika Kogyo Co., Ltd.), colloid mill (from SHINKO PANTEC CO., LTD.), slasher, trigonal wet pulverizer (from Mitsui Miike Machinery Co., Ltd.), CAVITRON® (from Eurotec), and FINE FLOW MILL® (from Pacific Machinery & Engineering Co., Ltd.); and batch type emulsifiers or batch/continuous emulsifiers such as CLEARMIX® (from M Technique) and FILMICS (from Tokushu Kika Kogyo Co., Ltd.).

When high shearing type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but the dispersing time is generally from 0.1 to 5 minutes. The temperature in the dispersing process is generally 0 to 150° C. (under pressure), and preferably from 10 to 98° C. The processing temperature is preferably as high as possible because the viscosity of the dispersion decreases and thereby the dispersing operation can be easily performed.

In the dispersing process, the weight ratio of the toner constituent liquid including a prepolymer and other toner constituents to the aqueous medium is generally from 100/50 to 100/2000, and preferably from 100/100 to 100/1000. When the amount of the aqueous medium is too small, the particulate organic material tends not to be well dispersed, and thereby a toner having a desired particle diameter cannot be prepared. In contrast, to use a large amount of aqueous medium is not economical.

The aqueous medium can include not only a surfactant but also a solid particulate dispersant (such as particulate resins) serving as an emulsification stabilizer.

Further, it is possible to stably disperse toner constituents in an aqueous liquid using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, γ-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose and hydroxypropyl cellulose, can also be used as the polymeric protective colloid.

When the dispersing operation is performed while using a dispersant, it is possible not to remove the dispersant from the resultant toner constituent particles. However, it is preferable to remove the dispersant remaining on the surface of the resultant toner constituent particles therefrom after the extension and/or crosslinking reaction of the prepolymer in view of charge properties of the resultant toner.

The time for extension and/or crosslinking reaction of the prepolymer are determined depending on the reactivity of the isocyanate of the prepolymer (A) used with the amine used. However, the reaction time are typically from 10 minutes to 40 hours, and preferably from 2 to 20 hours. The reaction temperature is typically from 0 to 150° C. and preferably from 40° C. to 98° C. In addition, known catalysts such as dibutyl tin laurate and dioctyl tin laurate can be added, if desired, when the reaction is performed.

In order to remove an organic solvent from the thus prepared emulsion, a method in which the emulsion is gradually heated to perfectly evaporate the organic solvent in the drops of the oil phase can be used. Alternatively, a method in which the emulsion is sprayed in a dry environment to dry the organic solvent in the drops of the oil phase and water in the dispersion, resulting in formation of toner particles, can be used. The dry environment can be formed by heating gases of air, nitrogen, carbon dioxide, combustion gas, etc., preferably, to a temperature not lower than the boiling point of the solvent having the highest boiling point among the solvents used in the emulsion. Toner particles having desired properties can be rapidly prepared by performing this treatment using a spray dryer, a belt dryer, a rotary kiln, etc.

When the thus prepared toner particles have a wide particle diameter distribution even after the particles are subjected to a washing treatment and a drying treatment, the toner particles are preferably subjected to a classification treatment using a cyclone, a decanter or a method utilizing centrifuge to remove fine particles therefrom. However, it is preferable to perform the classification operation in the liquid having the particles in view of efficiency. The toner particles having an undesired particle diameter can be reused as the raw materials. Such toner particles for reuse may be in a dry condition or a wet condition.

The dispersant used is preferably removed from the particle dispersion. The dispersant is preferably removed from the dispersion when the classification treatment is performed.

The thus prepared particulate organic material is surface-treated by the above-mentioned method to prepare the toner particles of the toner of the present invention.

The thus prepared toner particles can be mixed with one or more other particulate materials such as release agents, charge controlling agents, fluidizers and colorants optionally upon application of mechanical impact thereto to fix the particulate materials on the toner particles.

Specific examples of such mechanical impact application methods include methods in which a mixture is mixed with a highly rotated blade and methods in which a mixture is put into a jet air to collide the particles against each other or a collision plate.

Specific examples of such mechanical impact applicators include ONG MILL (manufactured by Hosokawa Micron Co., Ltd.), modified I TYPE MILL in which the pressure of air used for pulverizing is reduced (manufactured by Nippon Pneumatic Mfg. Co., Ltd.), HYBRIDIZATION SYSTEM (manufactured by Nara Machine Co., Ltd.), KRYPTRON SYSTEM (manufactured by Kawasaki Heavy Industries, Ltd.), automatic mortars, etc.

Method for Adhering Particulate Organic or Inorganic Material to Toner Constituent Particles The toner constituent particles prepared by the methods mentioned above can be treated with a particulate organic material and/or a particulate inorganic material in a liquid. It is preferable to perform this treatment after the toner constituent particles are washed to remove foreign materials such as free surfactants. Specifically, excessive surfactants present in a dispersion including the toner constituent particles are separated by subjecting the dispersion to filtering or centrifugal separation. Then the cake or slurry thus obtained is dispersed again in an aqueous medium. Then a particulate organic material and/or a particulate inorganic material are added to the dispersion and then a solution of a surfactant with a polarity different from that of the toner constituent particles (hereinafter referred to as a surfactant with a different polarity) is added thereto. Then the mixture is subjected to a dispersion treatment. The particulate material can be previously dispersed in the aqueous medium. In this case, it is preferable to disperse the particulate material using a surfactant with a different polarity because the particulate material can be efficiently adhered to the toner constituent particles.

The added amount of the solution is such that the weight ratio of the surfactant to the toner constituent particles is from $^{0.01}/_{100}$ to $^{1}/_{100}$.

When a surfactant with a different polarity is added, the charge of the particulate organic or inorganic material can be neutralized, and thereby the particulate material can be adhered to the surface of the toner constituent particles while aggregating.

The content of the particulate organic or inorganic material is preferably from 0.01 to 5% by weight based on total weight of the toner constituent particles.

Then the mixture (i.e., slurry) is heated to fix the particulate material thus adhered on the surface of the toner constituent particles, resulting in prevention of releasing of the particulate material from the toner constituent particles. In this case, the mixture is preferably heated at a temperature not lower than the glass transition temperature of the binder resin included in the toner constituent particles. Alternatively, it is possible to heat after drying the thus treated toner constituent particles while preventing aggregation of the toner constituent particles, to fix the particulate organic or inorganic material on the toner constituent particles.

In addition, a charge controlling agent can be added to the slurry (i.e., a dispersion in which toner constituent particles are re-dispersed) to impart good charge properties to the toner constituent particles. Charge controlling agents are typically a powder, and can be dispersed in an aqueous medium using a surfactant for use in preparing toner constituent particles or a surfactant with a different polarity. By using a surfactant with a different polarity, the charge of the charge controlling agents in an aqueous medium can be neutralized, and thereby the charge controlling agents can be adhered to the toner constituent particles while aggregating.

The particle diameter of the charge controlling agents to be added is preferably form 0.01 to 1 μm in the dispersion, and the added amount thereof is from 0.01 to 5% by weight based on the total weight of the toner constituent particles.

Suitable acidic groups for use as the polar group present on the surface of the toner constituent particles include carboxylic acid groups, sulfonic acid groups, and phosphoric acid groups. Among these groups, carboxylic acid groups are preferable because of easily incorporated in polyester resins and acrylic resins.

Suitable basic groups for use as the polar group present on the surface of the toner constituent particles include amide groups, methylol groups, pyridine groups, pyrrolidone groups, imdidazole groups, imine groups, and amino groups. Among these groups, amino groups are preferable because of easily incorporated in polyester resins and acrylic resins and having high polarity.

Surfactant

As mentioned above, surfactants are used for preparing the toner constituent particles and for adhering an organic or inorganic particles to the toner constituent particles.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycin, di)octylaminoethyle)glycin, and N-alkyl-N,N-dimethylammonium betaine.

The added amount of the surfactant in the aqueous phase is from 0.1 to 10% by weight based on the total weight of the aqueous phase.

By using a fluorine-containing surfactant as the surfactant with different polarity, good charging properties and good charge rising property can be imparted to the result-ant toner particles.

Specific examples of anionic surfactants having a fluoroalkyl group include fluoroalkyl carboxylic acids having from 2 to 10 carbon atoms and their metal salts, disodium perfluorooctanesulfonylglutamate, sodium 3-{omega-fluoroalkyl(C6-C11)oxy}-1-alkyl(C3-C4) sulfonate, sodium 3-{omega-fluoroalkanoyl(C6-C8)-N-ethylamino}-1-propanesulfonate, fluoroalkyl(C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl (C6-C10)-N-ethylsulfonyl glycin, monoperfluoroalkyl(C6-C16) ethylphosphates, etc.

Specific examples of the marketed products of such surfactants include SARFRON® S-111, S-112 and S-113, which are manufactured by Asahi Glass Co., Ltd.; FLUORAD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surfactants having a fluoroalkyl group, which can disperse an oil phase including toner constituents in water, include primary, secondary and tertiary aliphatic amines having a fluoroalkyl group, aliphatic quaternary ammonium salts such as perfluoroalkyl (C6-C10)sulfoneamidepropyltrimethylammonium salts, benzalkonium salts, benzetonium chloride, pyridinium salts, imidazolinium salts, etc. Specific examples of the marketed products thereof include SARFRON® S-121 (from Asahi Glass Co., Ltd.); FLUORAD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In particular, when fluorine-containing quaternary ammonium salts having the below-mentioned formula (4) are used, the resultant toner has good charge stability even when environmental conditions are changed.

(4)

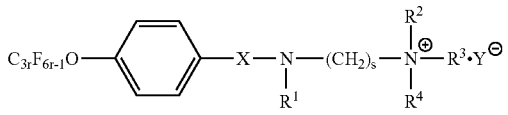

wherein X represents —$SO_2$, or —CO—; Y represents I or Br; $R^1$, $R^2$, $R^3$ and $R^4$ independently represent a hydrogen atom, an alkyl group having 1 to 10 carbon atoms or an aryl group; and each of r and s is an integer of from 1 to 20.

Specific examples of the compounds having formula (4) include the following compounds 1) to 54).

1)

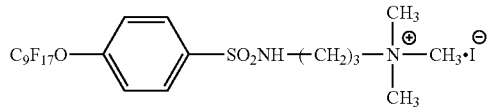

2)

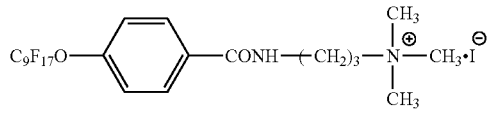

3)

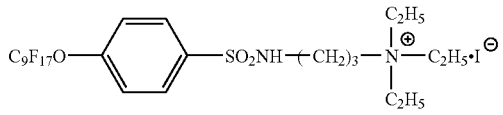

-continued
4)
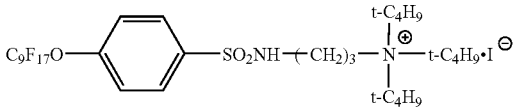
5)
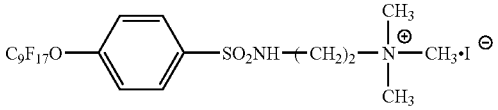
6)
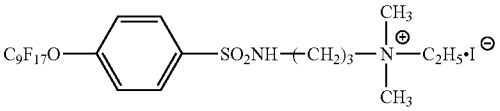
7)
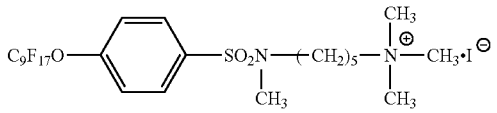
8)
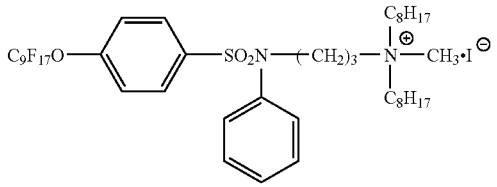
9)
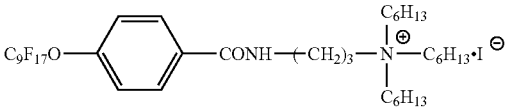
10)
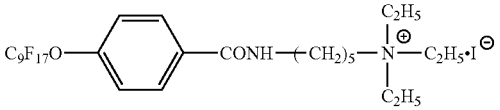
11)
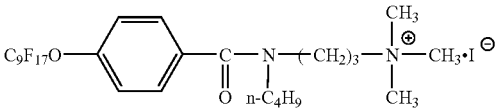
12)
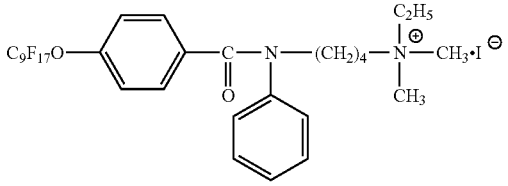
13)
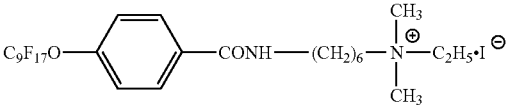
14)
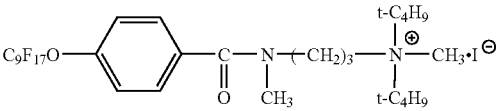
-continued
15)
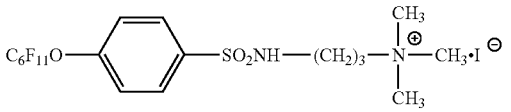
16)
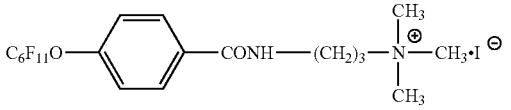
17)
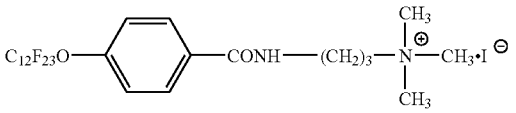
18)
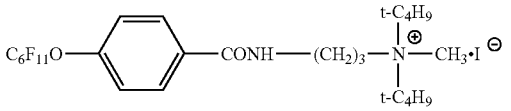
19)
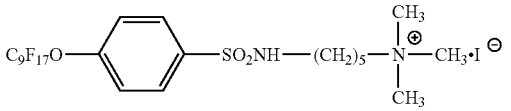
20)
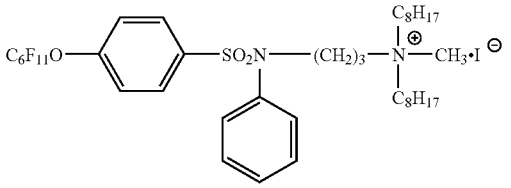
21)
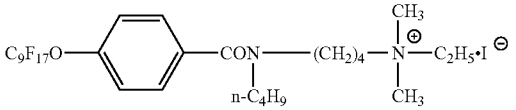
22)
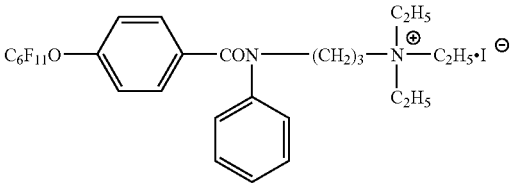
23)
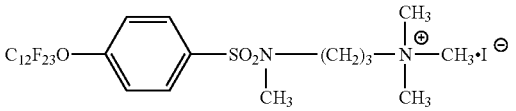
24)
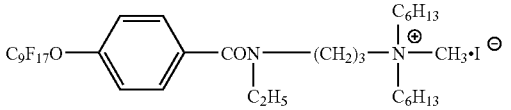
25)
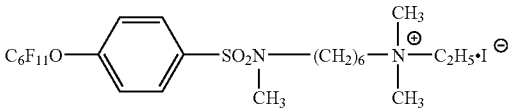

-continued
26)
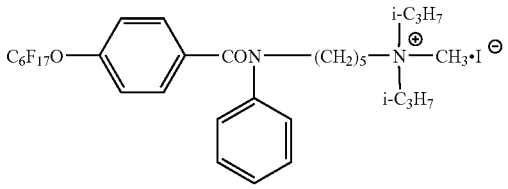
27)
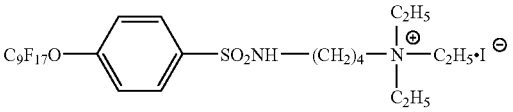
28)
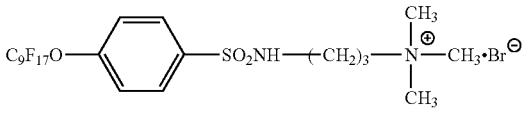
29)
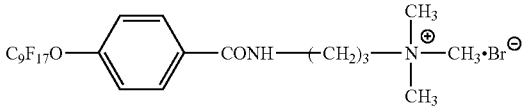
30)
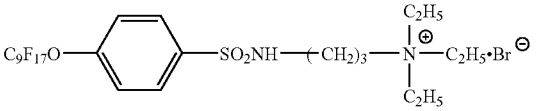
31)
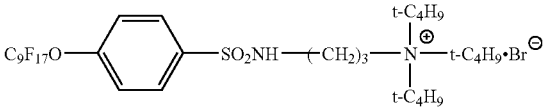
32)
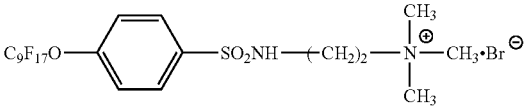
33)
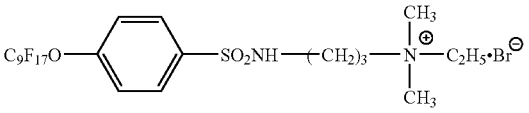
34)
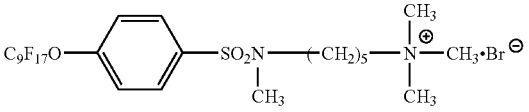
35)
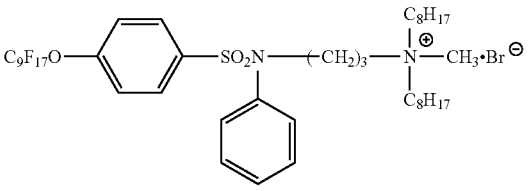
-continued
36)
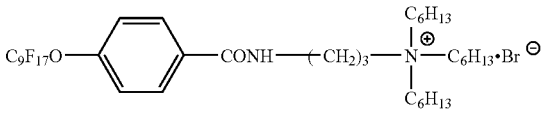
37)
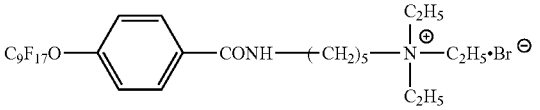
38)
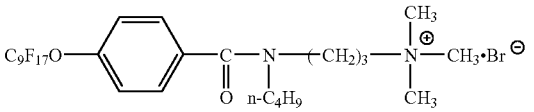
39)
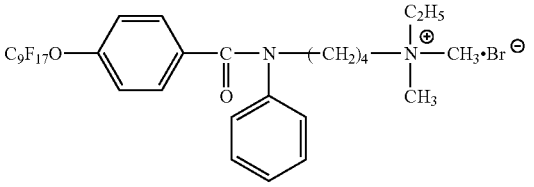
40)
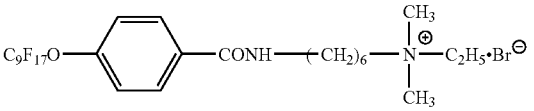
41)
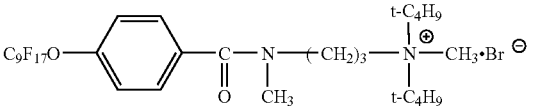
42)
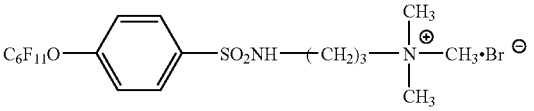
43)
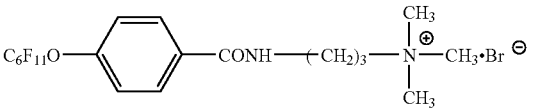
44)
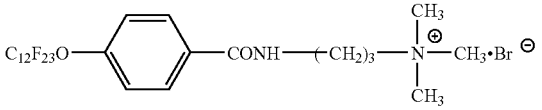
45)
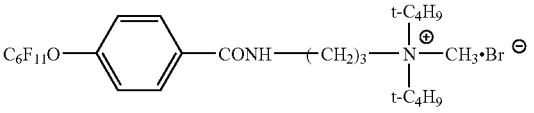

-continued

46)

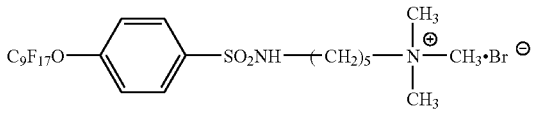

47)

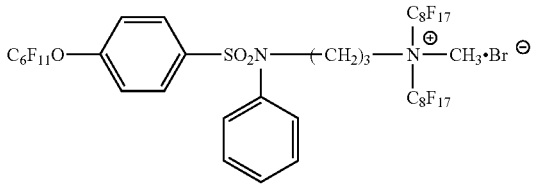

48)

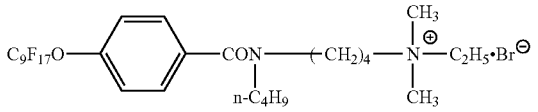

49)

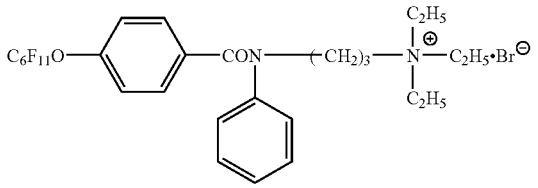

50)

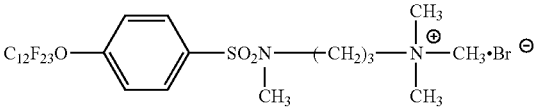

51)

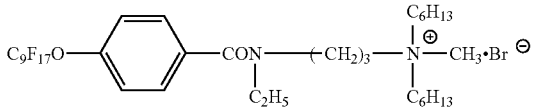

52)

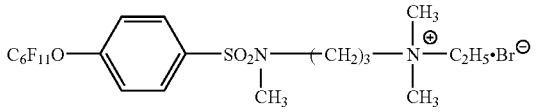

53)

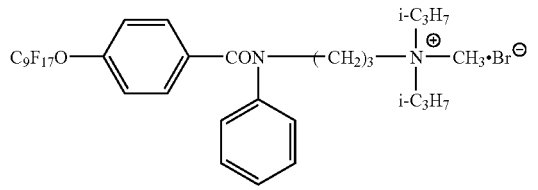

54)

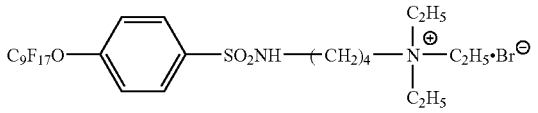

Particulate Organic Material

Suitable particulate organic material for use in the toner of the present invention include any known resins which can be dispersed in an aqueous medium. Specific examples of the resins include thermoplastic and thermosetting resins such as vinyl resins, polyurethane resins, epoxy resins, polyester resins, polyamide resins, polyimide resins, silicon-containing resins, phenolic resins, melamine resins, urea resins, aniline resins, ionomer resins, polycarbonate resins, etc. These resins can be used alone or in combination.

Among these resins, vinyl resins, polyurethane resins, epoxy resins, polyester resins and combinations thereof are preferably used because aqueous dispersions of the resins can be easily prepared. In view of charge properties, resin particle dispersions prepared by a method such as soap-free emulsion polymerization, suspension polymerization and dispersion polymerization are preferably used. Particularly, copolymers of a monomer having a carboxyl group (such as methacrylic acid) with a monomer such as styrene and fluorine-containing (meth)acrylate, which are prepared by a polymerization method such as emulsion polymerization and dispersion polymerization; polycondensation polymers such as silicone resins, benzoguanamine resins and nylon resins; and thermosetting resins.

The average particle diameter of the particulate organic materials is preferably not greater than one tenth (1/10) of the average particle diameter of toner particles. When the average particle diameter is too large, it becomes difficult to uniformly adhere the particulate organic material to toner particles.

The glass transition temperature (Tg) of the particulate organic materials is preferably from 55° C. to 100° C. When the glass transition temperature is too low, the preservability of the resultant toner deteriorates. In contrast, when the glass transition temperature is too high, the low temperature fixability of the resultant toner deteriorates.

The content of a particulate organic material in the toner of the present invention is preferably from 0.01% to 5.0% by weight based on the total weight of the toner.

Particulate Inorganic Material

Not only the particulate organic materials but also particulate inorganic materials can be adhered to the toner constituent particles in an aqueous medium. In addition, particulate inorganic materials can also be used as an external additive (i.e., fluidity improving agent) as mentioned below. Inorganic particulate materials having a primary particle diameter of from 5 nm to 2 μm are preferably used. Particularly, particulate materials having a primary particle diameter of from 100 nm to 2 μm are more preferably used, to prevent the particles from being embedded into the toner particles and to improve the cleanability of the resultant toner. The surface area of the particulate inorganic materials is preferably from 20 to 500 $m^2/g$ when measured by a BET method.

The content of a particulate inorganic material in the toner of the present invention is preferably from 0.01% to 5.0% by weight, and more preferably from 0.01% to 2.0% by weight, based on the total weight of the toner.

Specific examples of such inorganic materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

The polarity of the particulate inorganic materials is not particularly limited. When an acidic group is present on the surface of toner constituent particles, a cationic surfactant is preferably adhered. In this case, the particulate inorganic material to be adhered preferably has an acidic surface because of being efficiently adhered to the toner constituent particles.

In contrast, when the toner constituent particles have a basic surface, an anionic surfactant is preferably adhered. In this case, the particulate inorganic material to be adhered preferably has a basic surface. This is because the anionic surfactant is adsorbed on the surface of the particulate inorganic material, resulting in neutralization of charges of the inorganic material, and thereby the inorganic material can be easily adhered to the surface of the toner constituent particles.

The polarity of particulate inorganic materials can be easily changed by forming an oxide on the surface thereof or treating the surface thereof with a hydrophobic material.

Charge Controlling Agent

Any known charge controlling agents can be used for the toner of the present invention to control the charge properties of the toner.

Specific examples of the charge controlling agent include Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

Particulate Solid Dispersant

Suitable particulate solid dispersants for use in an aqueous medium used for preparing the toner constituent particles include particulate materials which hardly soluble in water and which have an average particle diameter of from 0.01 to 1 μm.

Specific examples of such materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, tricalcium phosphate, silicon carbide, silicon nitride, colloidal titanium oxide, colloidal silica, and hydroxyapatite, etc.

Among the materials, tricalcium phosphate, calcium carbonate, colloidal titanium oxide, colloidal silica, and hydroxyapatite can be preferably used. Particularly, hydroxyapatite which is synthesized by reacting sodium phosphate with calcium chloride under alkaline conditions is more preferable.

In addition, particles of low molecular weight organic compounds; and polymers such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin, can also be used as the solid dispersant when the toner constituent particles are prepared in an aqueous medium.

Prepolymer Having an Isocyanate Group at its End Portion

A prepolymer is preferably used for preparing toner constituent particles using the polymer suspension method. A prepolymer serves as a binder resin of the resultant toner while being further polymerized during the toner particle preparation process.

As the polyester prepolymer, for example, compounds prepared by reacting a polycondensation product of a polyol (1) and a polycarboxylic acid (2) including a group having an active hydrogen with a polyisocyanate (3) are used. Suitable groups having an active hydrogen include a hydroxyl group (an alcoholic hydroxyl group and a phenolic hydroxyl group), an amino group, a carboxyl group, a mercapto group, etc. Among these groups, alcoholic hydroxyl groups are preferable.

Suitable polyols (1) include diols (1-1) and polyols (1-2) having three or more hydroxyl groups. Preferably, diols (1-1) or mixtures in which a small amount of a polyol (1-2) is added to a diol (1-1) are used.

Specific examples of the diols (1-1) include alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); adducts of the bisphenols mentioned above with an alkylene oxide (e.g., ethylene oxide, propylene oxide and butylene oxide); etc.

Among these compounds, alkylene glycols having from 2 to 12 carbon atoms and adducts of bisphenols with an alkylene oxide are preferable. More preferably, adducts of bisphenols with an alkylene oxide, or mixtures of an adduct of bisphenols with an alkylene oxide and an alkylene glycol having from 2 to 12 carbon atoms are used.

Specific examples of the polyols (1-2) include aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (2) include dicarboxylic acids (2-1) and polycarboxylic acids (2-2) having three or more carboxyl groups. Preferably, dicarboxylic acids (2-1) or mixtures in which a small amount of a polycarboxylic acid (2-2) is added to a dicarboxylic acid (2-1) are used.

Specific examples of the dicarboxylic acids (2-1) include alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (2-2) having three or more hydroxyl groups include aromatic polycarboxylic acids having from 9 to 20 carbon atoms (e.g., trimellitic acid and pyromellitic acid).

As the polycarboxylic acid (2), anhydrides or lower alkyl esters (e.g., methyl esters, ethyl esters or isopropyl esters) of the polycarboxylic acids mentioned above can be used for the reaction with a polyol (1).

Suitable mixing ratio (i.e., an equivalence ratio [OH]/[COOH]) of (the [OH] of) a polyol (1) to (the [COOH] of) a polycarboxylic acid (2) is from 2/1 to 1/1, preferably from 1.5/1 to 1/1 and more preferably from 1.3/1 to 1.02/1.

Specific examples of the polyisocyanates (3) include aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

Suitable mixing ratio (i.e., [NCO]/[OH]) of (the [NCO] of) a polyisocyanate (3) to (the [OH] of) a polyester is from 5/1 to 1/1, preferably from 4/1 to 1.2/1 and more preferably from 2.5/1 to 1.5/1. When the [NCO]/[OH] ratio is too large, the low temperature fixability of the toner deteriorates. In contrast, when the ratio is too small, the content of the urea group in the modified polyesters decreases and thereby the hot-offset resistance of the toner deteriorates. The content of the constitutional component of a polyisocyanate (3) in the polyester prepolymer (A) having a polyisocyanate group at its end portion is from 0.5 to 40% by weight, preferably from 1 to 30% by weight and more preferably from 2 to 20% by weight. When the content is too low, the hot offset resistance of the toner deteriorates and in addition the heat resistance and low temperature fixability of the toner also deteriorate. In contrast, when the content is too high, the low temperature fixability of the toner deteriorates.

The number of the isocyanate group included in a molecule of the polyester prepolymer (A) is not less than 1, preferably from 1.5 to 3, and more preferably from 1.8 to 2.5. When the number of the isocyanate group is too small, the molecular weight of the resultant urea-modified polyester decreases and thereby the hot offset resistance deteriorate.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the amines (1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The molecular weight of the urea-modified polyesters can be controlled using an extension inhibitor, if desired. Specific examples of the extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., a ratio [NCO]/[NHx]) of (the [NCO] of) the prepolymer (A) having an isocyanate group to (the [NHx] of) the amine (B) is from 1/2 to 2/1, preferably from 1.5/1 to 1/1.5 and more preferably from 1.2/1 to 1/1.2. When the mixing ratio is too low or too high, the molecular weight of the resultant urea-modified polyester decreases, resulting in deterioration of the hot offset resistance of the resultant toner.

The urea-modified polyesters may include a urethane bonding as well as a urea bonding. The molar ratio (urea/urethane) of the urea bonding to the urethane bonding is from 100/0 to 10/90, preferably from 80/20 to 20/80 and more preferably from 60/40 to 30/70. When the content of the urea bonding is too low, the hot offset resistance of the resultant toner deteriorates.

Unmodified Polyester Resin (UMPE)

It is preferable to use a combination of a urea-modified polyester resin with an unmodified polyester resin (UMPE) as the binder resin of the toner of the present invention. By using such a combination, the low temperature fixability of the toner can be improved and in addition the toner can produce color images having a high glossiness.

Suitable materials for use as the unmodified polyester resins (UMPE) include polycondensation products of a polyol (1) with a polycarboxylic acid (2). Specific examples of the polyol (1) and polycarboxylic acid (2) are mentioned above for use in the modified polyester resins. In addition, specific examples of the suitable polyol and polycarboxylic acid are also mentioned above.

In addition, polyester resins modified by a bonding (such as urethane bonding) other than a urea bonding are considered as the unmodified polyester resin in the present application.

When a combination of a modified polyester resin with an unmodified polyester resin is used as the binder resin, it is preferable that the modified polyester resin is at least partially mixed with the unmodified polyester resin to improve the low temperature fixability and hot offset resistance of the toner. Namely, it is preferable that the modified polyester resin has a molecular structure similar to that of the unmodified polyester resin. The mixing ratio (MPE/UMPE) of a modified polyester resin (MPE) to an unmodified polyester resin (UMPE) is from 5/95 to 60/40, preferably from 5/95 to 30/70, more preferably from 5/95 to 25/75, and even more preferably from 7/93 to 20/80. When the added amount of the modified polyester resin is too small, the hot offset resistance of the toner deteriorates and in addition, it is impossible to achieve a good combination of high-temperature preservability and low temperature fixability.

The peak molecular weight of the unmodified polyester resins (UMPE) is from 1,000 to 30,000, preferably from 1,500 to 10,000 and more preferably from 2,000 to 8,000. When the peak molecular weight is too low, the high-temperature preservability of the toner deteriorates. In contrast, when the peak molecular weight is too high, the low temperature fixability of the toner deteriorates.

The unmodified polyester resin (UMPE) preferably has a hydroxyl value not less than 5 mg KOH/g, and more preferably from 10 to 120 mg KOH/g, and even more preferably from 20 to 80 mg KOH/g. When the hydroxyl value is too small, the resultant toner has poor preservability and poor low temperature fixability.

The unmodified polyester resin (UMPE) preferably has an acid value of from 1 to 30 mg KOH/g, and more preferably from 5 to 20 mg KOH/g. When a wax having a high acid value is used as a release agent, good negative charge property can be imparted to the toner.

The binder resin for use in the toner of the present invention preferably has a glass transition temperature (Tg) of from 50 to 70° C. and more preferably from 55 to 65° C. When the glass transition temperature is too low, the preservability of the toner deteriorates. In contrast, when the glass transition temperature is too high, the low temperature fixability deteriorates. When the toner of the present invention includes a urea-modified polyester resin and an unmodified polyester resin, the toner has relatively good preservability compared to conventional toners including a polyester resin as a binder resin even when the glass transition temperature of the toner of the present invention is lower than the polyester resin included in the conventional toners.

With respect to the storage modulus of the toner binder for use in the toner of the present invention, the temperature (TG') at which the storage modulus is 10,000 dyne/cm$^2$ when measured at a frequency of 20 Hz is not lower than 100° C., and preferably from 110 to 200° C.

With respect to the viscosity of the binder resin, the temperature (Tη) at which the viscosity is 1,000 poise when measured at a frequency of 20 Hz is not higher than 180° C., and preferably from 90 to 160° C. When the temperature (Tη) is too high, the low temperature fixability of the toner deteriorates. In order to achieve a good combination of low temperature fixability and hot offset resistance, it is preferable that the TG' is higher than the Tη. Specifically, the difference (TG'−Tη) is preferably not less than 0° C., preferably not less than 10° C. and more preferably not less than 20° C. The difference particularly has an upper limit. In order to achieve a good combination of high temperature preservability and low temperature fixability, the difference (TG'−Tη) is preferably from 0 to 100° C., more preferably from 10 to 90° C. and even more preferably from 20 to 80° C.

Colorant

The toner of the present invention includes a colorant. Suitable materials for use as the colorant include known dyes and pigments.

Specific examples of the dyes and pigments include carbon black, Nigrosine dyes, black iron oxide, Naphthol Yellow S (C.I. 10316), Hansa Yellow 10G (C.I. 11710), Hansa Yellow 5G (C.I. 11660), Hansa Yellow G (C.I. 11680), Cadmium Yellow, yellow iron oxide, loess, chrome yellow, Titan Yellow, polyazo yellow, Oil Yellow, Hansa Yellow GR (C.I. 11730), Hansa Yellow A (C.I. 11735), Hansa Yellow RN (C.I. 11740), Hansa Yellow R (C.I. 12710), Pigment Yellow L (C.I. 12720), Benzidine Yellow G (C.I. 21095), Benzidine Yellow GR (C.I. 21100), Permanent Yellow NCG (C.I. 20040), Vulcan Fast Yellow 5G (C.I. 21220), Vulcan Fast Yellow R (C.I. 21135), Tartrazine Lake, Quinoline Yellow Lake, Anthrazane Yellow BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red F2R (C.I. 12310), Permanent Red F4R (C.I. 12335), Permanent Red FRL (C.I. 12440), Permanent Red FRLL (C.I. 12460), Permanent Red F4RH (C.I. 12420), Fast Scarlet VD, Vulcan Fast Rubine B (C.I. 12320), Brilliant Scarlet G, Lithol Rubine GX (C.I. 12825), Permanent Red F5R, Brilliant Carmine 6B, Pigment Scarlet 3B, Bordeaux 5B, Toluidine Maroon, Permanent Bordeaux F2K (C.I. 12170), Helio Bordeaux BL (C.I. 14830), Bordeaux 10B, Bon Maroon Light (C.I. 15825), Bon Maroon Medium (C.I. 15880), Eosin Lake, Rhodamine Lake B, Rhodamine Lake Y, Alizarine Lake, Thio indigo Red B, Thio indigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue RS (C.I. 69800), Indanthrene Blue BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These-materials are used alone or in combination.

The content of the colorant in the toner is preferably from 1 to 15% by weight, and more preferably from 3 to 10% by weight of the toner.

Master batches, which are complexes of a colorant with a resin, can be used as the colorant of the toner of the present invention.

Specific examples of the resins for use as the binder resin of the master batches include the modified and unmodified polyester resins as mentioned above, styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins are used alone or in combination.

The master batches can be prepared by mixing one or more of the resins as mentioned above and one or more of the colorants as mentioned above and kneading the mixture while applying a high shearing force thereto. In this case, an organic solvent can be added to increase the interaction between the colorant and the resin. In addition, a flushing method in which an aqueous paste including a colorant and water is mixed with a resin dissolved in an organic solvent and kneaded so that the colorant is transferred to the resin side (i.e., the oil phase), and then the organic solvent (and water, if desired) is removed can be preferably used because the resultant wet cake can be used as it is without being dried. When performing the mixing and kneading process, dispersing devices capable of applying a high shearing force such as three roll mills can be preferably used.

Release Agent

The toner of the present invention can include a wax as a release agent in combination with a binder resin and a colorant.

Known waxes can be used for the toner of the present invention. Specific examples of the waxes include polyolefin waxes such as polyethylene waxes and polypropylene waxes; hydrocarbons having a long chain such as paraffin waxes and SASOL waxes; and waxes having a carbonyl group. Specific examples of the waxes having a carbonyl group include esters of polyalkanoic acids (e.g., carnauba waxes, montan waxes, trimethylolpropane tribehenate, pentaerythritol tetrabehenate, pentaerythritol diacetate dibehenate, glycerin tribehenate and 1,18-octadecanediol distearate); polyalkanol esters (e.g., tristearyl trimellitate and distearyl maleate); polyalkanoic acid amides (e.g., ethylenediamine dibehenyl amide); polyalkylamides (e.g., trimellitic acid tristearylamide); and dialkyl ketones (e.g., distearyl ketone) Among these waxes having a carbonyl group, polyalkananoic acid esters are preferably used.

The melting point of the waxes for use in the toner of the present invention is from 40 to 160° C., preferably from 50 to 120° C., more preferably from 60 to 90° C. When the melting point of the wax used is too low, the preservability of the resultant toner deteriorates. In contrast, when the melting point is too high, the resultant toner tends to cause a cold offset problem in that a toner image adheres to a fixing roller when the toner image is fixed at a relatively low fixing temperature.

The waxes preferably have a melt viscosity of from 5 to 1000 cps (i.e., 5 to 1000 mPa·s), and more preferably from 10 to 100 cps, at a temperature 20° C. higher than the melting point thereof. Waxes having too high a melt viscosity hardly produce offset resistance improving effect and low temperature fixability improving effect.

The content of a wax in the toner of the present invention is generally from 0 to 40% by weight, and preferably from 3 to 30% by weight.

Dry Toner Manufacturing Method

If desired, the toner particles (i.e., mother toner particles) prepared above are mixed with an external additive (e.g., hydrophobized silica and titanium oxide) using a mixer to improve fluidity, developing properties and transferring properties.

In order that the external additive does not contaminate the parts of image forming apparatus for which the toner including the external additive is used, the external additive is preferbly adhered to toner particles in a liquid. However, in order to further improving the fluidity and charge properties of the toner, a small amount of external additive can be further mixed with the toner under dry conditions. In particular, particles having a relatively large particle diameter (such as particles with a particle diameter of from 100 nm to 2 μm), which are effective in preventing fluidity improving agents from being embedded into toner particles and improving the cleanability of the resultant toner, are preferably adhered to the toner particles in a liquid. When an external additive is further adhered to the surface of the thus prepared toner particles under dry conditions, the external additive preferably has a relatively small particle diameter compared to that of the particles which are already adhered to the toner particles.

Suitable mixers for use in mixing the mother toner particles and an external additive include known mixers for mixing powders, which preferably have a jacket to control the inside temperature thereof.

By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed.

In addition, a mixing method in which at first a relatively high stress is applied and then a relatively low stress is applied to the external additive, or vice versa, can also be used.

Specific examples of the mixers include V-form mixers, locking mixers, Loedge Mixers, Nauter Mixers, Henschel Mixers and the like mixers.

When it is desired to change the shape of the thus prepared toner particles, mechanical methods such as hybridization methods and mechano-fusion methods, or methods in which toner particles are heated in an aqueous medium, can be preferably used, but the method is not limited thereto.

External Additive

The thus prepared toner particles are optionally mixed with an external additive such as fluidity improving agents. Inorganic fine particles are typically used as the external additive (i.e., fluidity improving agent). Inorganic particulate materials having a primary particle diameter of from 5 nm to 2 μm are typically used. More preferably, the primary particle diameter is from 100 nm to 2 μm to prevent the inorganic materials from being embedded into toner particles and to improve the cleanability of the toner. The surface area of the inorganic particulate materials is preferably from 20 to 500 $m^2/g$ when measured by a BET method.

The content of the inorganic particulate material is preferably from 0.01% to 5.0% by weight, and more preferably from 0.01% to 2.0% by weight, based on the total weight of the toner.

Specific examples of such inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

Particles of a polymer such as polystyrene, polymethacrylates, and polyacrylate copolymers, which are prepared by a polymerization method such as soap-free emulsion polymerization methods, suspension polymerization methods and dispersion polymerization methods; particles of a polymer such as silicone, benzoguanamine and nylon, which are prepared by a polymerization method such as polycondensation methods; and particles of a thermosetting resin can also be used as the external additive of the toner of the present invention.

The external additive used for the toner of the present invention is preferably subjected to a hydrophobizing treatment to prevent deterioration of the fluidity and charge properties of the resultant toner particularly under high humidity conditions. Suitable hydrophobizing agents for use in the hydrophobizing treatment include silicone oils, silane coupling agents, silylation agents, silane coupling agents having a fluorinated alkyl group, organic titanate coupling agents, aluminum coupling agents, etc.

In addition, the toner preferably includes a cleanability improving agent which can impart good cleaning property to the toner such that the toner remaining on the surface of an image bearing member such as a photoreceptor even after a toner image is transferred can be easily removed. Specific examples of such a cleanability improving agent include fatty acids and their metal salts such as stearic acid, zinc stearate, and calcium stearate; and particulate polymers such as polymethylmethacrylate and polystyrene, which are manufactured by a method such as soap-free emulsion polymerization methods.

Particulate resins having a relatively narrow particle diameter distribution and a volume average particle diameter of from 0.01 μm to 1 μm are preferably used as the cleanability improving agent.

Carrier for Use in Two Component Developer

The toner of the present invention can be used for a two-component developer in which the toner is mixed with a magnetic carrier. The weight ratio (T/C) of the toner (T) to the carrier (C) is preferably from 1/100 to 10/100.

Suitable carriers for use in the two component developer include known carrier materials such as iron powders, ferrite powders, magnetite powders, magnetic resin carriers, which have a particle diameter of from about 20 to about 200 μm. The surface of the carriers may be coated by a resin.

Specific examples of such resins to be coated on the carriers include amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethyleneterephthalate resins and polybutyleneterephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder may be included in the toner. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The toner of the present invention can also be used as a one-component magnetic developer or a one-component non-magnetic developer.

Then the image forming method and apparatus of the present invention, which produce images using the toner of the present invention, will be explained referring to drawings.

FIG. 1 is a schematic view illustrating an electrophotographic image forming apparatus for use in the image forming method of the present invention, which has a single photoreceptor and plural (four) developing devices.

In FIG. 1, a photoreceptor 1 is charged with a charger 2, and exposed to imagewise light L to form an electrostatic latent image thereon. The electrostatic latent image is developed with a color developer included in one of four developing devices 3*a*, 3*b*, 3*c* and 3*d* of a developing unit 3, resulting in formation of a color toner image on the surface of the photoreceptor 1. Then the color toner image is transferred on an intermediate transfer medium 4. In this case, an electric field is applied to the intermediate transfer medium 4. The surface of the photoreceptor 1 is cleaned by a cleaner 5 after the toner image is transferred.

This image forming operation is repeated with respect to four colors, and a full color toner image constituted of four color toner images is formed on the intermediate transfer medium 4.

The full color toner image on the intermediate transfer medium 4 is transferred to a receiving material 10 while an electric field is applied to the receiving material 10 by a transfer roller 7. Then the surface of the intermediate transfer medium 4 is cleaned by a cleaner 6 having a cleaning blade.

Each of the developing devices 3*a*, 3*b*, 3*c* and 3*d* has a developing roller on which a developer layer including the toner of the present invention is formed by a developing blade. The electrostatic latent image formed on the photoreceptor 1 is developed with the developer layer formed on the developing roller.

Figure 2:
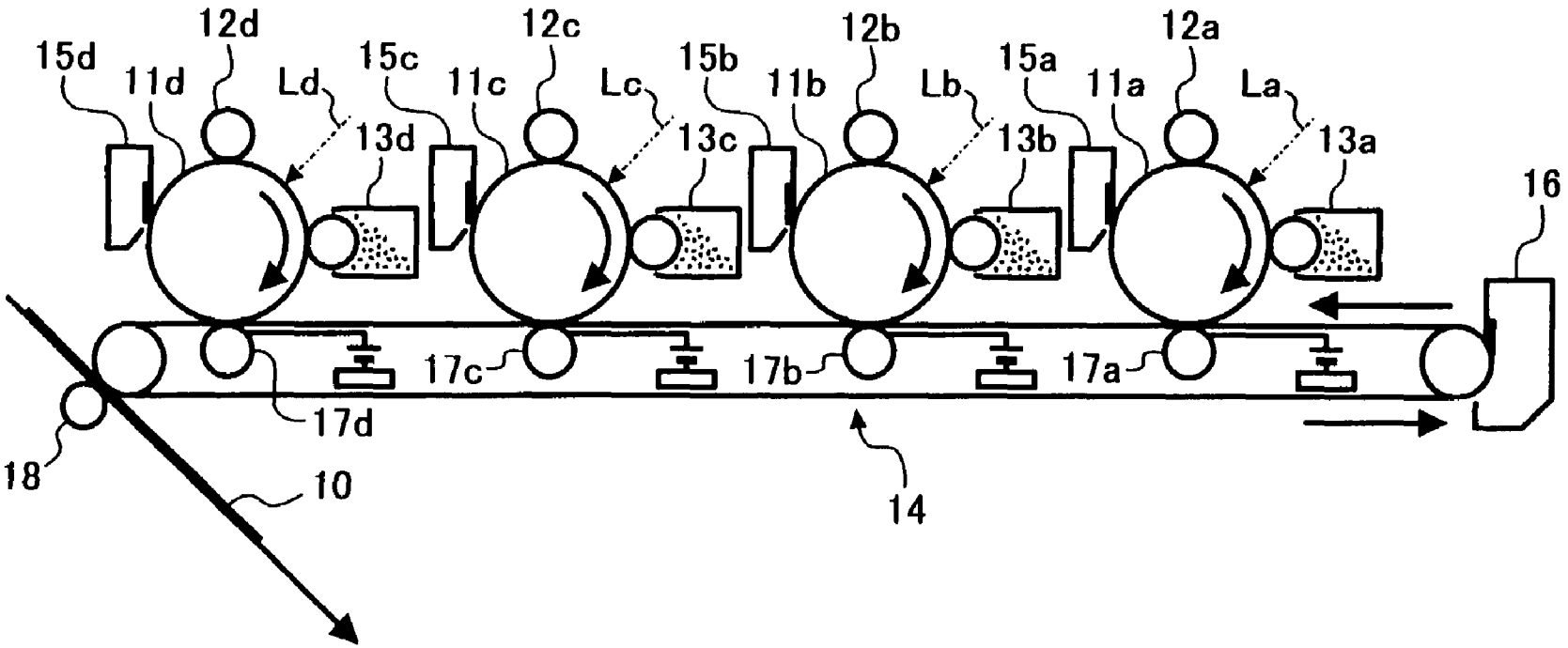
FIG. 2 is a schematic view illustrating another image forming apparatus for use in the image forming method of the present invention.

FIG. 2 is a schematic view illustrating another image forming apparatus for use in the image forming method of the present invention, which has four photoreceptors and four developing devices.

Similarly to the image forming apparatus described in FIG. 1, four color toner images are formed on respective photoreceptors 11*a*, 11*b*, 11*c* and 11*d* using respective chargers, 12*a*, 12*b*, 12*c* and 12*d*; respective imagewise light beams La, Lb, Lc and Ld; and respective developing devices 13*a*, 13*b*, 13*c* and 13*d*. The thus prepared four color toner images are transferred to an intermediate transfer medium 14 by respective transfer rollers 17*a*, 17*b*, 17*c* and 17*d* while an electric field is applied thereto, resulting in formation of a full color toner image on the intermediate transfer medium 14. Then the full color toner image is transferred on a receiving material 10 by a transfer roller 18.

The surfaces of the photoreceptors 11*a*, 11*b*, 11*c* and 11*d* are cleaned with respective cleaners 15*a*, 15*b*, 15*c* and 15*d*. In addition, the surface of the intermediate transfer medium 14 is cleaned with a cleaner 16.

Each of the developing devices 13*a*, 13*b*, 13*c* and 13*d* has a developing roller on which a developer layer including the toner of the present invention is formed by a developing blade. The electrostatic latent images formed on the photoreceptor 11*a*, 11*b*, 11*c* and 11*d* are developed with the respective developer layers formed on the respective developing rollers.

Figure 3:
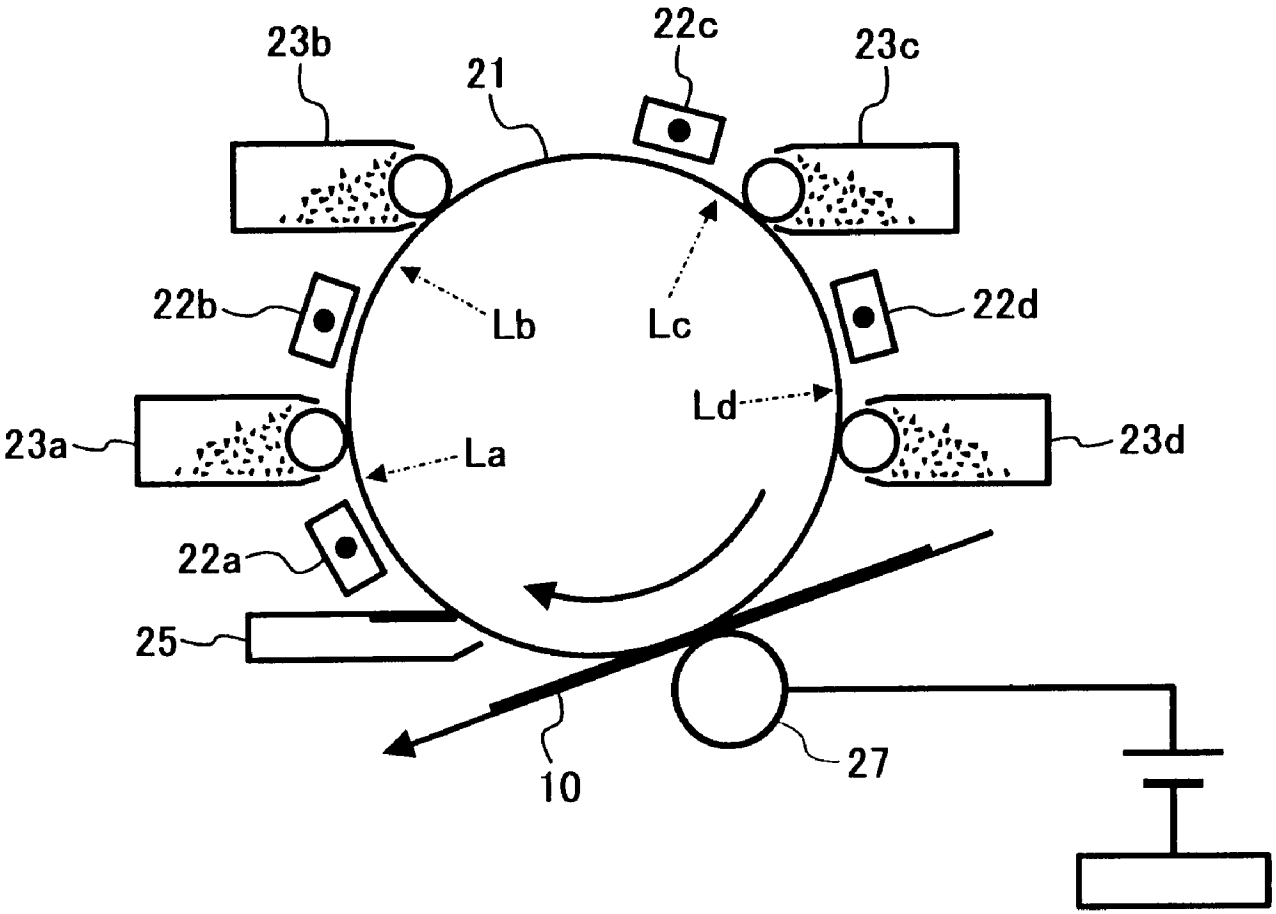
FIG. 3 is a schematic view illustrating yet another image forming apparatus for use in the image forming method of the present invention.

FIG. 3 is a schematic view illustrating yet another image forming apparatus for use in the image forming method of the present invention, which has a single photoreceptor and plural (four) developing devices.

Similarly to the image forming apparatus described in FIG. 1, four color toner images are formed one by one on a photoreceptor 21 using respective chargers, 22*a*, 22*b*, 22*c* and 22*d*; respective imagewise light beams La, Lb, Lc and Ld; and respective developing devices 23*a*, 23*b*, 23*c* and 23*d*. The four color toner images are transferred one by one to a receiving material 10 by a transfer roller 27 while an electric field is applied to the receiving material 10, resulting in formation of a full color toner image on the receiving material 10.

The surface of the photoreceptor 21 is cleaned by a cleaner 25.

Each of the developing devices 23*a*, 23*b*, 23*c* and 23*d* has a developing roller on which a developer layer including the toner of the present invention is formed by a developing blade. The electrostatic latent image corresponding to a color image formed on the photoreceptor 21 is developed with the corresponding developer layer formed on the corresponding developing roller.

The structure of the image forming apparatus is not limited to those illustrated in FIGS. 1 to 3.

Figure 4:
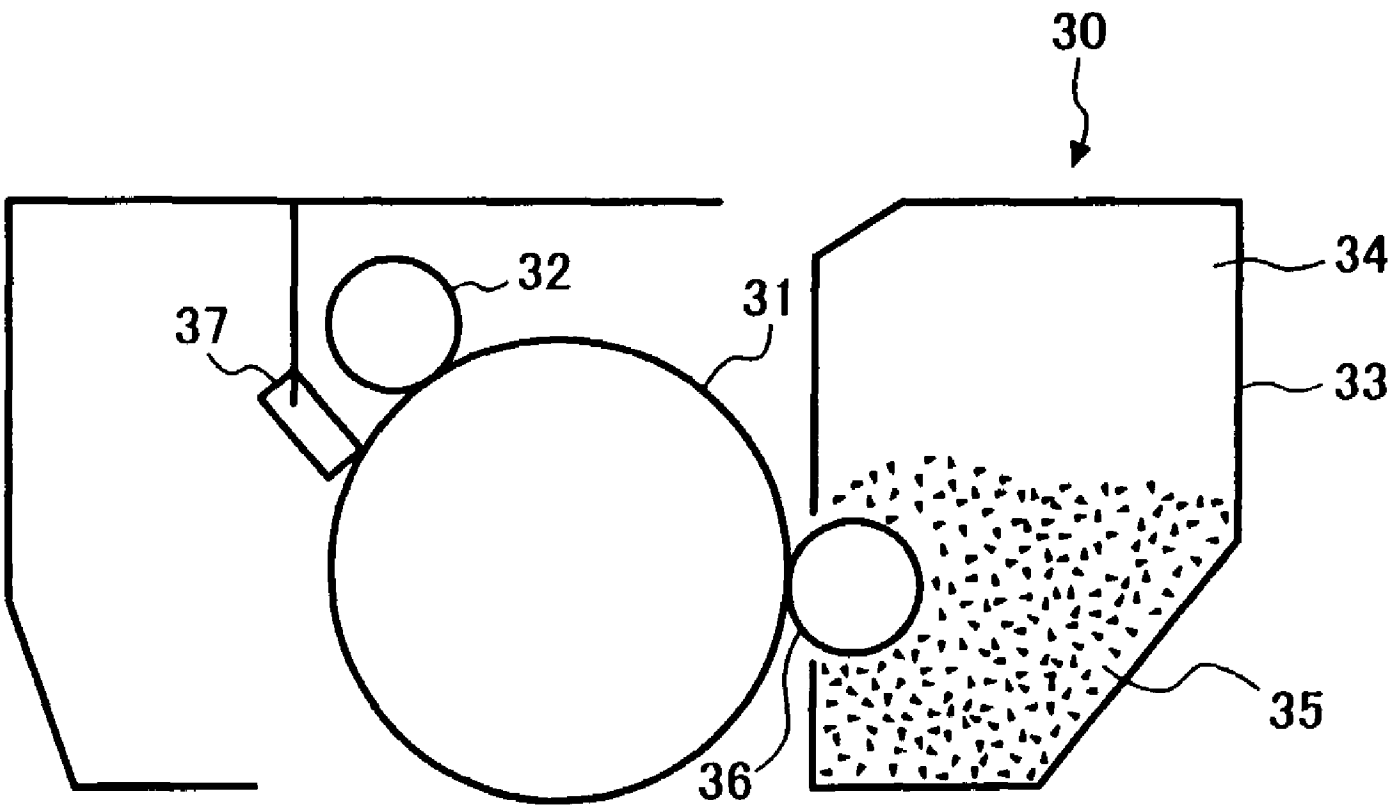
FIG. 4 is a schematic view illustrating an embodiment of the process cartridge of the present invention.

FIG. 4 is a schematic view illustrating an embodiment of the process cartridge of the present invention.

In FIG. 4, a process cartridge 30 includes a photoreceptor 31 serving as an electrostatic latent image bearing member, a charger 32 configured to charge the photoreceptor 31, a developing device 33 configured to develop the latent image with a developer 35 including the toner of the present invention, and a cleaner 37 configured to clean the surface of the photoreceptor 31.

The developing device 33 includes a developer container 34 configured to contain the developer 35 including the toner of the present invention, and a developing roller 36 configured to develop the latent image on the surface of the photoreceptor 31.

The structure of the process cartridge of the present invention is not limited to that illustrated in FIG. 4. The process cartridge of the present invention includes a developer container containing a developer including the toner of the present invention, and at least one member selected from the group consisting of an image bearing member, a charger configured to charge the image bearing member, a developing device configured to develop an electrostatic latent image with the developer, and a cleaner configured to clean the surface of the image bearing member.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Particulate Resin Dispersion (1)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 83 parts of styrene, 83 parts of methacrylic acid, 110 parts of butyl acrylate, and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/butyl acrylate/sodium salt of sulfate of ethylene oxide adduct of methacrylic acid, hereinafter referred to as particulate resin dispersion (1)) was prepared.

The volume-average particle diameter of the particles in the particulate resin dispersion (1), which was measured by an instrument LA-920 from Horiba Ltd., was 105 nm. Part of the particulate resin dispersion (1) was dried to solidify the resin. The glass transition temperature and weight average molecular weight of the resin were 59° C. and 150,000, respectively.

Preparation of Unmodified Polyester Resin

The following components were contained in a reaction container equipped with a condenser, a stirrer and a nitrogen introducing tube to perform a polycondensation reaction for 8 hours at 230° C. under normal pressure.

| | |
|---|---|
| Adduct of bisphenol A with 2 mole of ethylene oxide | 724 parts |
| Terephthalic acid | 276 parts |
| Dibutyl tin oxide | 2 parts |

Then the reaction was further continued for 5 hours under a reduced pressure of from 10 to 15 mmHg. Thus, an unmodified polyester resin having a peak molecular weight of 4800 was prepared.

Then 10 parts of trimellitic anhydride were added thereto, and the mixture was reacted for 2 hours at 200° C. under a reduced pressure of from 10 to 15 mmHg to replace the hydroxyl group at the end portion of the resin with a carboxyl group.

One hundred (100) parts of the thus prepared polyester resin were dissolved in 100 parts of ethyl acetate to prepare an ethyl acetate solution of the binder resin.

A part of the resin solution was dried to solidify the polyester resin. The polyester resin had a glass transition temperature of 62° C., and an acid value of 32 mgKOH/g.

Example 1

At first, 200 parts of the ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Thus, a toner constituent mixture liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then the toner constituent mixture liquid prepared above was added thereto, and the mixture was agitated for 3 minutes to prepare an emulsion.

Then the emulsion was transferred to a flask equipped with a stirrer and a thermometer, followed by heating for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate is not higher than 100 ppm in the dispersion.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation was performed three times. The thus prepared cake was dispersed again in distilled water so that the solid content is 10% by weight to prepare a dispersion including toner constituent particles.

Then 1000 parts of the thus prepared dispersion were mixed with 18 parts of the above-prepared resin dispersion (1). In this case, the content of the particulate resin (1) in the toner constituent particles was 3% by weight. Further, 30 parts of a 1% by weight aqueous solution of stearyl amine acetate were gradually added to the mixture. In this case, the weight ratio of stearyl amine acetate to the toner constituent particles was 3%. The mixture was agitated for 1 hour at room temperature, followed by filtering to prepare a cake. The cake was dried for 24 hours at 40° C. Thus, toner particles were prepared. It was confirmed from observation of the toner particles with a scanning electron microscope that the particulate resin having a particle diameter of 105 nm is uniformly adhered to the surface of the toner constituent particles.

One hundred (100) parts of the thus prepared toner particles were mixed with 0.5 parts of a hydrophobized silica R972 (from Nippon Aerosil Co.) and 0.5 parts of a hydrophobized titanium oxide MT150AI (from Titan Kogyo K.K.) using a HENSCHEL mixer. Thus, a toner of the present invention was prepared.

Preparation of Polyester Prepolymer having Isocyanate Group at its End Portion

The following components were contained in a reaction vessel equipped with a condenser, a stirrer and a nitrogen introducing tube and reacted for 8 hours at 230° C. under normal pressure.

| | |
|---|---|
| Adduct of bisphenol A with 2 mole of ethylene oxide | 724 parts |
| Isophthalic acid | 276 parts |
| Dibutyl tin oxide | 2 parts |

Then the reaction was further continued for 5 hours under a reduced pressure of from 10 to 15 mmHg, followed by cooling to 160° C. Further, 32 parts of phthalic anhydride were added thereto to perform a reaction for 2 hours at 160° C.

After being cooled to 80° C., the reaction product was reacted with 188 parts of isophorone diisocyanate in ethyl acetate for 2 hours. Thus, a polyester prepolymer having an isocyanate group was prepared.

Preparation of Ketimine Compound

In a reaction vessel equipped with a stirrer and a thermometer, 170 parts of isophorone diamine and 75 parts of methyl ethyl ketone were contained and reacted for 5 hours at 50° C. to prepare a ketimine compound. The ketimine compound has an amine value of 418 mgKOH/g.

Example 2

At first, 200 parts of the ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Then the polyester prepolymer prepared above was added thereto in such an amount that the solid of the prepolymer is 20 parts, and the mixture was agitated. Thus, a toner constituent mixture liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then a mixture (i.e., an oil phase liquid) of the toner constituent mixture liquid prepared above and 1 part of the above-prepared ketimine compound which had been added to the toner constituent mixture liquid just before was added thereto, and the mixture was agitated for 3 minutes to prepare an emulsion.

Then the emulsion was transferred to a flask equipped with a stirrer and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate in the dispersion is not higher than 100 ppm.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation was performed three times. The thus prepared cake was dispersed again in distilled water so that the solid content is 10% by weight.

Then 1000 parts of the thus prepared dispersion were mixed with 18 parts of the above-prepared resin dispersion (1). In this case, the weight ratio of the particulate resin (1) to the toner constituent particles was 3%. Further, 30 parts of a 1% by weight aqueous solution of stearyl amine acetate were gradually added to the mixture. In this case, the weight ratio of stearyl amine acetate to the toner constituent particles was 3%. The mixture was agitated for 1 hour at room temperature, followed by filtering to prepare a cake. The cake was dried for 24 hours at 40° C. Thus, toner particles were prepared. It was confirmed from observation of the toner particles with a scanning electron microscope that the particulate resin (1) having a particle diameter of 105 nm is uniformly adhered to the surface of the toner constituent particles.

One hundred (100) parts of the thus prepared toner particles were mixed with 0.5 parts of a hydrophobized silica R972 (from Nippon Aerosil Co.) and 0.5 parts of a hydrophobized titanium oxide MT150AI (from Titan Kogyo K.K.) using a HENSCHEL mixer. Thus, a toner of the present invention was prepared.

Comparative Example 1

The procedure for preparation of the toner in Example 1 was repeated except that the particulate resin dispersion (1)

was not added and 30 parts of the 1% aqueous solution of stearylamine acetate were replaced with 48 parts of a mixture of 0.2 parts of stearylamine acetate and 100 parts of deionized water. Thus, a comparative toner was prepared.

Comparative Example 2

The procedure for preparation of the toner in Example 2 was repeated except that the particulate resin dispersion (1) was not added and 30 parts of the 1% aqueous solution of stearylamine acetate were replaced with 48 parts of a mixture of 0.2 parts of stearylamine acetate and 100 parts of deionized water. Thus, a comparative toner was prepared.

Example 3

The procedure for preparation of the toner in Example 2 was repeated except that the stearyamine acetate was replaced with a fluorine-containing cationic surfactant F150 (from Dainippon Ink and Chemicals, Inc.). Thus, toner particles were prepared. It was confirmed from observation of the toner particles with a scanning electron microscope that the particulate resin (1) having a particle diameter of 105 nm is uniformly adhered to the surface of the toner constituent particles.

Example 4

The procedure for preparation of the toner in Example 2 was repeated except that the stearyamine acetate was replaced with N,N,N-trimethyl-[3-(4-perfluorononenyloxybenzamide)propyl]ammonium iodide (i.e., FUTARGENT 310, from Neos). Thus, toner particles were prepared. It was confirmed from observation of the toner particles with a scanning electron microscope that the particulate resin having a particle diameter of 105 nm is uniformly adhered to the surface of the toner constituent particles.

Example 5

The procedure for preparation of the toner in Example 2 was repeated except that the added amount of the 1% by weight aqueous solution of stearyl amine acetate was changed from 30 parts to 10 parts, and the mixture was agitated for 1 hour at 50° C., followed by filtering and drying of the resultant cake at 40° C. for 24 hours.

Thus, toner particles were prepared. It was confirmed from observation of the toner particles with a scanning electron microscope that the particulate resin having a particle diameter of 105 nm is uniformly adhered to the surface of the toner constituent particles while slightly embedded into the toner constituent particles.

One hundred (100) parts of the thus prepared toner particles were mixed with 0.5 parts of a hydrophobized silica R972 (from Nippon Aerosil Co.) and 0.5 parts of a hydrophobized titanium oxide MT150AI (from Titan Kogyo K.K.) using a HENSCHEL mixer.

One hundred (100) parts of the thus prepared toner particles were mixed with 0.5 parts of a hydrophobized silica R972 (from Nippon Aerosil Co.) and 0.5 parts of a hydrophobized titanium oxide MT150AI (from Titan Kogyo K.K.) using a HENSCHEL mixer. Thus, a toner of the present invention was prepared.

Preparation of Particulate Resin Dispersion (2)

In a reaction vessel equipped with a stirrer and a thermometer, 683 parts of water, 11 parts of a sodium salt of sulfate of an ethylene oxide adduct of methacrylic acid (ELEMINOL RS-30 from Sanyo Chemical Industries Ltd.), 138 parts of styrene, 138 parts of methacrylic acid, and 1 part of ammonium persulfate were contained. The mixture was agitated for 15 minutes while the stirrer was rotated at a revolution of 400 rpm. As a result, a milky emulsion was prepared. Then the emulsion was heated to 75° C. to react the monomers for 5 hours.

Further, 30 parts of a 1% aqueous solution of ammonium persulfate were added thereto, and the mixture was aged for 5 hours at 75° C. Thus, an aqueous dispersion of a vinyl resin (i.e., a copolymer of styrene/methacrylic acid/sodium salt of sulfate of ethylene oxide adduct of methacrylic acid, hereinafter referred to as particulate resin dispersion (2)) was prepared.

The volume-average particle diameter of the particles in the particulate resin dispersion (2), which was measured by an instrument LA-920 from Horiba Ltd., was 0.05 μm.

Example 6

At first, 200 parts of the ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Then the polyester prepolymer prepared above was added thereto in such an amount that the solid of the prepolymer is 20 parts, and the mixture was agitated. Thus, a toner constituent mixture liquid was prepared.

On the other hand, 20 parts of the particulate resin dispersion (2) prepared above, and 3 parts of sodium dodecylbenzenesulfonate were dissolved and dispersed in 600 parts of deionized water contained in a beaker. The mixture was agitated by a ROBOMIX from Tokushu Kika Kogyo Co., Ltd. while the rotor of ROBOMIX was rotated at a revolution of 15,000 rpm and the temperature of the mixture was maintained at 20° C. Then a mixture (i.e., an oil phase liquid) of the toner constituent mixture liquid prepared above and 1 part of the above-prepared ketimine compound which had been added to the toner constituent mixture liquid just before was added thereto, and the mixture was agitated for 3 minutes to prepare an emulsion.

Then the emulsion was transferred to a flask equipped with a stirrer and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate in the dispersion is not higher than 100 ppm.

The thus prepared dispersion was filtered. The thus prepared cake was dispersed in distilled water to be washed, followed by filtering. This washing operation was performed three times. The thus prepared cake was dispersed again in distilled water so that the solid content is 10% by weight.

Then the thus prepared dispersion was mixed with the above-prepared particulate resin dispersion (1) while an aqueous solution of stearylamine acetate was gradually added thereto. In this case, the content of stearylamine acetate was 0.1% by weight. The mixture was agitated for 1 hour at room temperature, followed by filtering to prepare a cake. The cake was dried for 24 hours at 40° C. Thus, toner particles were prepared. It was confirmed from observation of the toner particles with a scanning electron microscope that the particulate resin (2) having a particle diameter of 0.05 μm is uniformly adhered to the surface of the toner constituent particles and in addition the particulate resin (1) having a particle diameter of 105 nm is uniformly adhered on the particulate resin (2).

One hundred (100) parts of the thus prepared toner particles were mixed with 0.5 parts of a hydrophobized silica R972 (from Nippon Aerosil Co.) and 0.5 parts of a hydrophobized titanium oxide MT150AI (from Titan Kogyo K.K.) using a HENSCHEL mixer. Thus, a toner of the present invention was prepared.

Evaluation of Toner

Five (5) parts of each toner were mixed with 95 parts of a carrier, which had been prepared as follows, using a blender. Thus, a two-component developer was prepared.

Preparation of Carrier

A spherical ferrite having an average particle diameter of 50 μm which serves as a core material was coated with a coating liquid, which had been prepared by dispersing an aminosilane coupling agent and a silicone resin in toluene, using a spray coating method. Then the coated carrier was calcined and then cooled. Thus, a coated carrier with a resin layer having a thickness of 0.2 μm was prepared.

The toner and developer were evaluated as follows.

(1) Charge Rising Property (CRP)

One hundred (100) parts of the coated carrier and 5 parts of each of the toners prepared above were contained in a stainless pot under conditions of 20° C. 50% RH. The pot containing the toner and the coated carrier was set on a ball mill stand to be rotated at a predetermined revolution. After the pot was rotated for 15 second, the charge quantity (units of μC/g) of the developer in the pot was determined by a blow-off method.

(2) Saturation Charge Quantity (SCQ)

The saturation charge quantity (units of μC/g) of each developer was determined in the same way as that mentioned above in numbered paragraph (1) except that the rotation was performed for 10 minutes.

(3) Preservability

Each toner was contained in a glass container, and the toner was allowed to settle for 24 hours in a chamber heated to 50° C. After being cooled to 24° C., the toner was subjected to a penetration test using a method based on JIS K2235-1991 to determine the penetration of the toner in the glass container. In this regard, the more penetration value a toner has, the better preservability the toner has. The preservability of toners is graded into the following five ranks:

◎: Entire the toner layer is penetrated by the needle. (best)

○: Penetration is not less than 25 mm.

□: Penetration is not less than 20 mm and less than 25 mm.

Δ: Penetration is not less than 15 mm and less than 20 mm.

X: Penetration is less than 15 mm. (worst)

(4) Fixable Temperature Range (FTR)

Each developer was set in a marketed color copier, PRETER 550 from Ricoh Co., Ltd. Then an original image with image area proportion of 7% was repeatedly copied on sheets of a paper, TYPE 6000 from Ricoh Co., Ltd. Thus, a 30,000-sheet running test was performed. After the 30,000-copy running test, a solid toner image was formed on entire the surface of a sheet of the paper at various fixing temperatures of from 100° C. to 220° C. Then an adhesive tape was adhered to each solid image and then the tape was peeled therefrom to determine whether the toner is transferred to the tape. The tape was observed while compared with a standard sample to determine whether the amount of the transferred toner (i.e., the degree of soil of the adhesive tape, hereinafter soil degree) is not greater than that of the standard sample. The lowest fixing temperature (Tmin) is the minimum of the fixing temperature range in which the resultant toner image has a soil degree not greater than that of the standard sample. The maximum fixing temperature (Tmax) is defined as a fixing temperature, above which a hot offset problem is caused. The fixable temperature range is defined as (Tmax−Tmin).

The evaluation results are shown in Table 1.

TABLE 1

| | (1) CRP (μC/g) | (2) SCQ (μC/g) | (3) Preservability (rank) | (4) FTR (° C.) |
|---|---|---|---|---|
| Ex. 1 | −16.6 | −14.1 | □ | 20 |
| Ex. 2 | −15.0 | −12.6 | ○ | 80 |
| Ex. 3 | −28.7 | −24.5 | ○ | 80 |
| Ex. 4 | −30.4 | −26.0 | ○ | 80 |
| Ex. 5 | −16.5 | −13.3 | ◎ | 75 |
| Ex. 6 | −44.3 | −35.8 | ◎ | 85 |
| Comp. Ex. 1 | +7.3 | −8.7 | X | 10 |
| Comp. Ex. 2 | +14.6 | −4.1 | Δ | 60 |

Example 7

At first, 200 parts of the ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Thus, a toner constituent mixture liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then the toner constituent mixture liquid prepared above was added thereto, and the mixture was agitated for 3 minutes to prepare an emulsion.

Then the emulsion was transferred to a flask equipped with a stirrer and a thermometer, followed by heating for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate is not higher than 100 ppm in the dispersion.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation was performed three times. The thus prepared cake was dispersed again in distilled water so that the solid content is 10% by weight to prepare a dispersion including toner constituent particles.

On the other hand, 3 parts of a hydrophobized silica X-24 (from Shin-Etsu Chemical Co., Ltd.) were gradually added to a mixture of 0.2 parts of stearylamine acetate, 70 parts of deionized water, and 30 parts of methanol to prepare a silica dispersion. The silica dispersion was added to the above-prepared dispersion, and the mixture was agitated for one hour at room temperature. Then the mixture was filtered, and the cake was dried for 24 hours at 40° C. Thus, toner particles were prepared. It was confirmed from observation of the toner particles with a scanning electron microscope that the particulate silica having a particle diameter of about 0.12 μm is uniformly adhered to the surface of the toner constituent particles.

Example 8

At first, 200 parts of the ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Then the polyester prepolymer prepared above was added thereto in such an amount that the solid of the prepolymer is 20 parts, and the mixture was agitated. Thus, a toner constituent mixture liquid was prepared.

On the other hand, 60 parts of tricalcium phosphate and 3 parts of sodium dodecylbenzenesulfonate were dissolved and dispersed in 600 parts of deionized water contained in a beaker. The mixture was agitated by a TK HOMOMIXER from Tokushu Kika Kogyo Co., Ltd. while the rotor of TK HOMOMIXER was rotated at a revolution of 12,000 rpm and the temperature of the mixture was maintained at 20° C. Then a mixture (i.e., an oil phase liquid) of the toner constituent mixture liquid prepared above and 1 part of the above-prepared ketimine compound which had been added to the toner constituent mixture liquid just before was added thereto, and the mixture was agitated for 3 minutes to prepare an emulsion.

Then the emulsion was transferred to a flask equipped with a stirrer and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate in the dispersion is not higher than 100 ppm.

The thus prepared dispersion was cooled to room temperature, and 120 parts of a 35% concentrated hydrochloric acid were added thereto to dissolve the tricalcium phosphate in the dispersion. The mixture was then agitated for 1 hour at room temperature, followed by filtering.

The thus prepared cake was dispersed in distilled water to be washed, followed by filtering. This washing operation was performed three times. The thus prepared cake was dispersed again in distilled water so that the solid content is 10% by weight.

The silica dispersion prepared in Example 1 was gradually added to the dispersion prepared above. The mixture was agitated for 1 hour at room temperature, followed by filtering to prepare a cake. The cake was dried for 24 hours at 40° C. Thus, toner particles were prepared. It was confirmed from observation of the toner particles with a scanning electron microscope that the silica having a particle diameter of about 0.12 μm is uniformly adhered to the surface of the toner constituent particles.

Comparative Example 3

The procedure for preparation of the toner in Example 7 was repeated except that the silica dispersion was replaced with 103.2 parts of a mixture of 0.2 parts of stearylamine acetate, 70 parts of deionized water and 30 parts of methanol. Thus, a comparative toner was prepared.

Comparative Example 4

The procedure for preparation of the toner in Example 8 was repeated except that the silica dispersion was replaced with 103.2 parts of a mixture of 0.2 parts of stearylamine acetate, 70 parts of deionized water and 30 parts of methanol. Thus, a comparative toner was prepared.

Example 9

The procedure for preparation of the toner in Example 8 was repeated except that stearyamine acetate in the silica dispersion was replaced with a fluorine-containing cationic surfactant F150 (from Dainippon Ink and Chemicals, Inc.). Thus, toner particles were prepared.

Example 10

The procedure for preparation of the toner in Example 8 was repeated except that the stearyamine acetate in the silica dispersion was replaced with N,N,N-trimethyl-[3-(4-perfluorononenyloxybenzamide)propyl]ammonium iodide (i.e., FUTARGENT 310, from Neos). Thus, toner particles were prepared.

Example 11

The procedure for preparation of the toner in Example 8 was repeated except that after the silica dispersion was added to the dispersion, the temperature of the mixture was maintained at 50° C. for one hour while agitating. Thus, toner particles were prepared.

It was confirmed from observation of the toner particles with a scanning electron microscope that the silica having a particle diameter of about 0.12 μm is uniformly adhered to the surface of the toner constituent particles.

Example 12

One hundred (100) parts of the toner particles prepared in Example 11 were mixed with 0.5 parts of a hydrophobized silica R972 (from Nippon Aerosil Co.) and 0.5 parts of a hydrophobized titanium oxide MT150AI (from Titan Kogyo K.K.) using a HENSCHEL mixer. Thus, a toner of the present invention was prepared.

Example 13

At first, 200 parts of the ethyl acetate solution of the unmodified polyester resin prepared above, 5 parts of a carnauba wax, and 4 parts of a copper phthalocyanine pigment were fed into a ball mill pot including zirconia balls having a diameter of 5 mm to be subjected to ball milling for 24 hours. Then the prepolymer prepared above was added thereto in such an amount that the solid of the prepolymer is 20 parts and the mixture was agitated. Thus, a toner constituent mixture liquid was prepared.

On the other hand, 20 parts of the particulate resin dispersion (2) prepared above, and 3 parts of sodium dodecylbenzenesulfonate were dissolved and dispersed in 600 parts of deionized water contained in a beaker. The mixture was agitated by a ROBOMIX from Tokushu Kika Kogyo Co., Ltd. while the rotor of ROBOMIX was rotated at a revolution of 15,000 rpm and the temperature of the mixture was maintained at 20° C. Then a mixture (i.e., an oil phase liquid) of the toner constituent mixture liquid prepared above and 1 part of the above-prepared ketimine compound which had been added to the toner constituent mixture liquid just before was added thereto, and the mixture was agitated for 3 minutes to prepare an emulsion.

Then the emulsion was transferred to a flask equipped with a stirrer and a thermometer and heated for 8 hours at 30° C. under a reduced pressure of 50 mmHg. Thus, the solvent (i.e., the ethyl acetate) was removed from the emulsion, resulting in preparation of a dispersion. It was confirmed by gas chromatography that the content of ethyl acetate in the dispersion is not higher than 100 ppm.

The thus prepared dispersion was filtered. The thus prepared cake was dispersed in distilled water to be washed, followed by filtering. This washing operation was performed three times. The thus prepared cake was dispersed again in distilled water so that the solid content is 10% by weight.

Then the above-prepared silica dispersion was gradually added to the thus prepared dispersion while agitating. The mixture was agitated for 1 hour at room temperature, followed by filtering to prepare a cake. The cake was dried for 24 hours at 40° C. Thus, toner particles were prepared. It was confirmed from observation of the toner particles with a scanning electron microscope that the particulate resin (3) having a particle diameter of about 0.05 μm is uniformly adhered to the surface of the toner constituent particles and in addition the silica having a particle diameter of about 0.12 μm is uniformly adhered on the particulate resin (3).

Evaluation of Toner

Five (5) parts of each toner were mixed with 95 parts of the above-prepared carrier using a blender. Thus, a two-component developer was prepared.

The toner and developer were evaluated as follows.

(1) Charge Rising Property (CRP)

The charge rising property was evaluated by the same method as mentioned above.

(2) Saturation Charge Quantity (SCQ)

The saturation charge quantity was evaluated by the same method as mentioned above.

(3) Cleanability

Each developer was set in a marketed color copier, PRETER 550 from Ricoh Co., Ltd. Then an original image with image area proportion of 7% was repeatedly copied on sheets of a paper, TYPE 6000 from Ricoh Co., Ltd. Thus, a 30,000-sheet running test was performed. After the 30,000-copy running test, 10 sheets of a full color solid image were continuously produced. When the tenth solid image was developed, the developing operation was suddenly stopped. An adhesive tape was adhered to an area of the photoreceptor, which area had been already cleaned by the cleaning blade, to transfer the toner particles remaining on the photoreceptor to the adhesive tape. The tape on which the remaining toner particles are transferred was observed while comparing the tape with toner particles with four levels of standard samples so as to be graded into the following four ranks.

◎: There is no toner particles on the adhesive tape. (excellent)

○: There are some toner particles on the tape, but the image quality (i.e., background fouling) is still acceptable.

Δ: One to ten streaks having a width not greater than 1 mm are formed on the resultant image of A4 size, which was produced while the A4 paper is fed in such a direction that the longitudinal direction of the paper is perpendicular to the paper feeding direction of the copier. This toner cannot be practically used.

X: Many streaks are formed on the resultant image. This toner cannot be practically used.

(4) Damage of Photoreceptor

A 100,000-sheet running test was performed in the same way as mentioned above. After the running test, a white image (i.e., no image) was formed to determine the number of undesired spot images thereon, i.e., to determine whether the photoreceptor is damaged. The evaluation is performed while the white image is graded to the following four ranks.

Rank 4: The number of undesired spot images is 0 or 1. (good)

Rank 3: The number of undesired spot images is 2 to 4.

Rank 2: The number of undesired spot images is 5 to 9.

Rank 1: The number of undesired spot images is not less than 10. (bad)

(5) High Temperature/High Humidity Saturation Charge Quantity

One hundred (100) parts of the coated carrier and 5 parts of each of the toners prepared above were allowed to settle under conditions of 30° C. 90% RH, and the carrier and the toner were contained in a stainless pot. The pot containing the toner and the coated carrier was set on a ball mill stand to be rotated at a predetermined revolution. After the pot was rotated for 10 minutes, the high temperature/high humidity saturation charge quantity (i.e., HH SCQ, units of μC/g) of the developer in the pot was determined by the blow-off method.

(6) Fixable Temperature Range

The fixable temperature range was evaluated by the same method as mentioned above.

The evaluation results are shown in Table 2.

TABLE 2

| | CRP (μC/g) | SCQ (μC/g) | Cleanability | Damage of photoreceptor | FTR (° C.) |
|---|---|---|---|---|---|
| Ex. 7 | −12 | −15 | Δ | Rank 3 | 30 |
| Ex. 8 | −10 | −13 | ○ | Rank 3 | 75 |
| Ex. 9 | −23 | −22 | ○ | Rank 3 | 75 |
| Ex. 10 | −35 | −30 | ○ | Rank 3 | 75 |
| Ex. 11 | −11 | −14 | ◎ | Rank 4 | 80 |
| Ex. 12 | −24 | −31 | ○ | Rank 2 | 70 |
| Ex. 13 | −27 | −29 | ◎ | Rank 4 | 80 |
| Comp. Ex. 3 | +15 | +23 | X | Rank 1 | 10 |
| Comp. Ex. 4 | +28 | +36 | X | Rank 1 | 70 |

Effects of the Present Invention

It is clear form the above description that by treating toner constituent particles which have a polar group with a first polarity thereon, with a surfactant having a polar group with a second polarity different from the first polarity and an organic and/or inorganic particulate material, good charge properties and good preservability can be imparted to the resultant toner. In addition, the resultant toner can produce high quality images having good fixing property.

By using the image forming method and the process cartridge using the toner of the present invention, high quality images can be stably produced.

This document claims priority and contains subject matter related to Japanese Patent Applications Nos. 2003-189576 and 2003-410297, filed on Jul. 1, 2003 and Dec. 9, 2003, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for preparing a toner comprising toner particles, comprising:

granulating a toner constituent mixture to prepare toner constituent particles having a polar group with a first polarity on a surface thereof; and mixing a surfactant having a second polarity different from the first polarity and a particulate material with the toner constituent particles to prepare the toner particles in which the particulate material is present on the surface of the toner constituent particles.

2. The method according to claim 1, wherein the particulate material comprises at least one of particulate organic material and a particulate inorganic material.

3. The method according to claim 2, wherein the particulate material is a particulate organic material having a glass transition temperature of from 55 to 100° C.

4. The method according to claim 1, wherein the granulating comprises any one of combination steps (1) to (4)

(1) a combination step comprising:

dissolving or dispersing at least a colorant in a polymerizable monomer to prepare a toner constituent mixture liquid;

dispersing the toner constituent mixture liquid in an aqueous medium comprising a surfactant to prepare an emulsion; and polymerizing the emulsion to prepare a suspension of toner constituent particles;

(2) a combination step comprising:

dispersing a toner constituent mixture including at least a resin and a colorant in an aqueous medium including a surfactant to prepare a toner constituent mixture liquid;

aggregating particles in the toner constituent mixture liquid; and heating the aggregated particles to fuse the aggregated particles in the aqueous medium to prepare a suspension of toner constituent particles;

(3) a combination step comprising:

dissolving or dispersing a toner constituent mixture comprising at least a resin and a colorant in an organic solvent to prepare a toner constituent mixture liquid;

dispersing the toner constituent mixture liquid in an aqueous medium to prepare an emulsion; and removing the organic solvent from the emulsion to prepare a suspension of toner constituent particles; and (4) a combination step comprising:

dissolving or dispersing a toner constituent mixture comprising at least a resin and a colorant in an organic solvent to prepare a toner constituent mixture liquid;

dispersing the toner constituent mixture liquid in an aqueous medium to prepare an emulsion;

subjecting the toner constituent mixture liquid to an addition polymerization reaction; and removing the organic solvent from the toner constituent mixture liquid to prepare a suspension of toner constituent particles.

5. The method according to claim 4, wherein the granulating comprises the combination step (4), and wherein the resin comprises a compound having an isocyanate group at an end thereof.

6. The method according to claim 1, wherein the polar group present on the surface of the toner constituent particles is a carboxyl group.

7. The method according to claim 1, wherein the polar group is an acidic group, and the surfactant is a surfactant selected from the group consisting of cationic surfactants, nonionic surfactants and ampholytic surfactants.

8. The method according to claim 1, wherein the polar group is a basic group, and the surfactant is a surfactant selected from the group consisting of anionic surfactants, nonionic surfactants and ampholytic surfactants.

9. The method according to claim 1, wherein the surfactant is a fluorine-containing surfactant.

10. The method according to claim 9, wherein the fluorine-containing surfactant comprises a perfluoralkyl group.

11. The method according to claim 10, wherein the surfactant is a compound having the following formula (1):

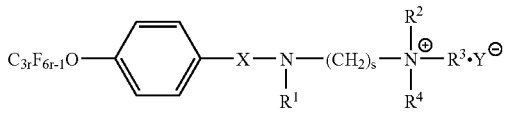

(1)

wherein X represents —$SO_2$, or —CO—; Y represents I or Br; $R^1$, $R^2$, $R^3$ and $R^4$ independently represent a hydrogen atom, an alkyl group having 1 to 10 carbon atoms or an aryl group; and each of r and s is an integer of from 1 to 20.

12. The method according to claim 1, further comprising:

heating the toner constituent particles in an aqueous medium after the surfactant and the particulate material are mixed with the toner constituent particles.

13. A toner comprising:

toner particles comprising a binder resin and a colorant; and an external additive, wherein the toner particles are prepared by the method according to claim 1.

14. An image forming method comprising:

developing an electrostatic latent image on at least one image bearing member with at least one color toner to form at least one color toner image on the at least one image bearing member;

transferring the at least one toner image on a receiving material; and fixing the at least one toner image on the receiving material, wherein the at least one toner is the toner according to claim 13.

15. The image forming method according to claim 14, wherein transferring step comprises:

transferring the at least one toner image on an intermediate transfer medium upon application of an electric field thereto;

second transferring the at least one toner image on the intermediate transfer medium to the receiving material.

16. The image forming method according to claim 14, wherein the developing comprises:

developing a plurality of electrostatic latent images formed on a plurality of image bearing members, respectively, with respective color toners to form a plurality of color toner images on the respective image bearing members.

17. The image forming method according to claim 16, wherein transferring step comprises:

transferring the plurality of color toner images on an intermediate transfer medium upon application of an electric field thereto;

second transferring the plurality of color toner images on the intermediate transfer medium to the receiving material.

18. A process cartridge comprising:

a developer container containing a developer comprising the toner according to claim 13, and at least one member selected from the group consisting of:

an image bearing member;

a charger configured to charge the image bearing member to form an electrostatic latent image thereon;

a developing device configured to develop the electrostatic latent image with the developer to form a toner image on the image bearing member; and a cleaner configured to clean a surface of the image bearing member.

* * * * *